US006698804B2

(12) United States Patent
Shiota et al.

(10) Patent No.: US 6,698,804 B2
(45) Date of Patent: Mar. 2, 2004

(54) ELECTRIC DOOR LOCK DEVICE OF MOTOR VEHICLE

(75) Inventors: Kouichi Shiota, Yokohama (JP); Jun Yamagishi, Yokohama (JP)

(73) Assignee: Ohi Seisakusho, Co., Ltd., Kanagawa (JP)

( * ) Notice: Subject to any disclaimer, the term of this patent is extended or adjusted under 35 U.S.C. 154(b) by 0 days.

(21) Appl. No.: 10/266,620

(22) Filed: Oct. 9, 2002

(65) Prior Publication Data

US 2003/0067175 A1 Apr. 10, 2003

(30) Foreign Application Priority Data

Oct. 10, 2001 (JP) ..... 2001-312756

(51) Int. Cl.[7] ..... E05C 3/06

(52) U.S. Cl. ..... 292/201; 292/DIG. 23; 292/DIG. 29

(58) Field of Search ..... 292/216, 201, 292/DIG. 23, DIG. 29; 49/279, 280

(56) References Cited

U.S. PATENT DOCUMENTS 4,762,348 A * 8/1988 Matsumoto ..... 292/201
4,875,723 A * 10/1989 Compeau ..... 292/201
5,083,397 A * 1/1992 Koura ..... 49/28
5,632,120 A * 5/1997 Shigematsu ..... 49/449
5,678,869 A * 10/1997 Yoshikuwa ..... 292/216
5,713,613 A * 2/1998 Honma ..... 292/201
6,048,002 A * 4/2000 Ohta ..... 292/201
6,131,967 A * 10/2000 Kondo ..... 292/201
6,145,354 A * 11/2000 Kondo ..... 70/279.1
6,386,599 B1 * 5/2002 Chevalier ..... 292/201

FOREIGN PATENT DOCUMENTS

JP 5-27748 4/1993

* cited by examiner

*Primary Examiner*—Gary Estremsky
(74) *Attorney, Agent, or Firm*—Sughrue Mion, PLLC

(57) ABSTRACT

A control unit is configured to carry out a given controlling of an electric motor when a given operation is carried. The given operation is an operation wherein under operation of a closure mechanism, the door is moved in a close direction passing through an operative position of a half-latch switch and then moved back in an open direction at a position just before the half-latch position. The given controlling is so made that when the moving member takes a position other than a neutral position upon completion of the given operation, the electric motor is rotated in a reversed direction to move the moving member to the neutral position, and when the moving member takes the neutral position upon completion of the given operation, the electric motor is stopped to keep the moving member at the neutral position.

9 Claims, 27 Drawing Sheets

ELECTRIC DOOR LOCK DEVICE OF MOTOR VEHICLE

BACKGROUND OF THE INVENTION

1. Field of Invention

The present invention relates in general to electric door lock devices of motor vehicles, and more particularly to the electric door lock devices of a type that comprises a closure mechanism that, upon sensing a half-lock condition of a lock device of the door, forces the lock device to take a full-lock position bringing the door to its full-closed locked position and an opening mechanism that, upon need of opening the door, cancels the locked engagement between a latch plate and a striker of the lock device.

2. Description of Related Art

Hitherto, various electric door lock devices of the above-mentioned type have been proposed and put into practical use particularly in the field of wheeled motor vehicles having a hatch back type door. One of them is disclosed in Japanese Patent Second Provisional Publication (Tokkohei) 5-27748. The device disclosed by this publication comprises a lock device that includes a latch plate engageable with a striker and a locking plate engageable with the latch plate to lock the same, and a drive device that includes a moving member movable in opposite directions from a neutral position with the aid of power produced by a reversible electric motor. That is, when moved in one direction, the moving member cancels a locked engagement between the latch plate and locking plate, and when moved in the other direction, the moving member moves the latch plate from a half-latch position to a full-latch position.

However, even the electric door lock device proposed by the publication has a shortcoming due to its inherent construction. That is, when the back door is subjected to a complicated handling during its closing movement, the back door fails to have a full closed and locked position.

SUMMARY OF THE INVENTION

Accordingly, an object of the present invention is provide an electric door lock device which can assuredly induce a full closed and locked position of the back door even when the door is subjected to a complicated handling during its closing movement.

According to a first aspect of the present invention, there is provided an electric door lock device which comprises a lock device including a latch plate engageable with a striker and a locking plate engageable with the latch plate to lock the same; a drive device including a reversible electric motor, a moving member driven by the electric motor, and a half-latch switch capable of sensing a half-latch position of the latch plate relative to the locking plate, the half-latch switch being arranged to issue a half-latch representing signal when the latch plate is about to take the half-latch position during a movement thereof that is induced when the door is being closed; a closure mechanism which, upon sensing of the half-latch position by the half-latch switch, induces rotation of the electric motor in a normal direction to move the moving member from a neutral position thereby moving the latch plate to a full-latch position relative to the locking plate, and upon arrival of the moving member at a reverse rotation position, induces rotation of the electric motor in a reversed direction thereby to return the moving member to the neutral position and stops rotation of the electric motor; and a control unit which is configured to carry out a given controlling of the electric motor when a given operation is carried out, the given operation being an operation wherein under operation of the closure mechanism, the door is moved in a close direction passing through an operative position of the half-latch switch and then moved back in an open direction at a position just before the half-latch position, the given controlling being so made that when the moving member takes a position other than the neutral position upon completion of the given operation, the electric motor is rotated in a reversed direction to move the moving member to the neutral position, and when the moving member takes the neutral position upon completion of the given operation, the electric motor is stopped to keep the moving member at the neutral position.

According to a second aspect of the present invention, there is provided an electric door lock device which comprises a lock device including a latch plate engageable with a striker and a locking plate engageable with the latch plate to lock the same; a drive device including a reversible electric motor, a moving member driven by the electric motor, and a half-latch switch capable of sensing a half-latch position of the latch plate relative to the locking plate, the half-latch switch being arranged to issue a half-latch representing signal when the latch plate is about to take the half-latch position during a movement thereof that is induced when the door is being closed; a closure mechanism which, upon sensing of the half-latch position by the half-latch switch, induces rotation of the electric motor in a normal direction to move the moving member from a neutral position thereby moving the latch plate to a full-latch position relative to the locking plate, and upon arrival of the moving member at a reverse rotation position, induces rotation of the electric motor in a reversed direction thereby to return the moving member to the neutral position and stops rotation of the electric motor; an opening mechanism which, upon sensing manipulation of a handle, induces rotation of the electric motor in a reversed direction to move the moving member from the neutral position in a direction to cancel a locked engagement between the latch plate and the locking plate and upon arrival of the moving member at the reversed rotation position, induces rotation of the electric motor in a normal direction to return the moving member to the neutral position and stops rotation of the electric motor; a cam possessed by the moving member; a close detecting switch engageable with the cam; an open detecting switch engageable with the cam; and a control unit which is configured to carry out a given controlling of the electric motor when a given operation is carried out, the given operation being an operation wherein under operation of the closure mechanism, the door is moved in a close direction passing through an operative position of the half-latch switch and then moved back in an open direction at a position just before the half-latch position, the given controlling being so made that when the moving member takes a position other than the neutral position upon completion of the given operation, the electric motor is rotated in a reversed direction to move the moving member to the neutral position, and when the moving member takes the neutral position upon completion of the given operation, the electric motor is stopped to keep the moving member at the neutral position, wherein when the close and open detecting switches assume respective operative positions, the control unit stops operation of the electric motor judging that the moving member has taken the neutral position, when the close detecting switch assumes an operative position and the open detecting switch assumes an inoperative position, the control unit continues rotation of the electric motor in a normal direction judging that the moving member has taken a first position other than the neutral position, when the close detecting switch assumes an inoperative position and the open detecting switch assumes an operative position, the control unit continues rotation of the electric motor in a reversed direction judging that the moving member has taken a second position other than the first and neutral positions and when the close and open detecting switches assume respective inoperative positions, the control unit rotates the electric motor in a reversed direction judging that the moving member has taken the reverse rotation position.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, the present invention will be described in detail with reference to the accompanying drawings.

For ease of understanding, various directional terms, such as right, left, upper, lower, rightward, etc., are contained in the following description. However, these terms are to be understood with respect to only a drawing or drawings on which the corresponding part or portion is shown.

Figure 1:
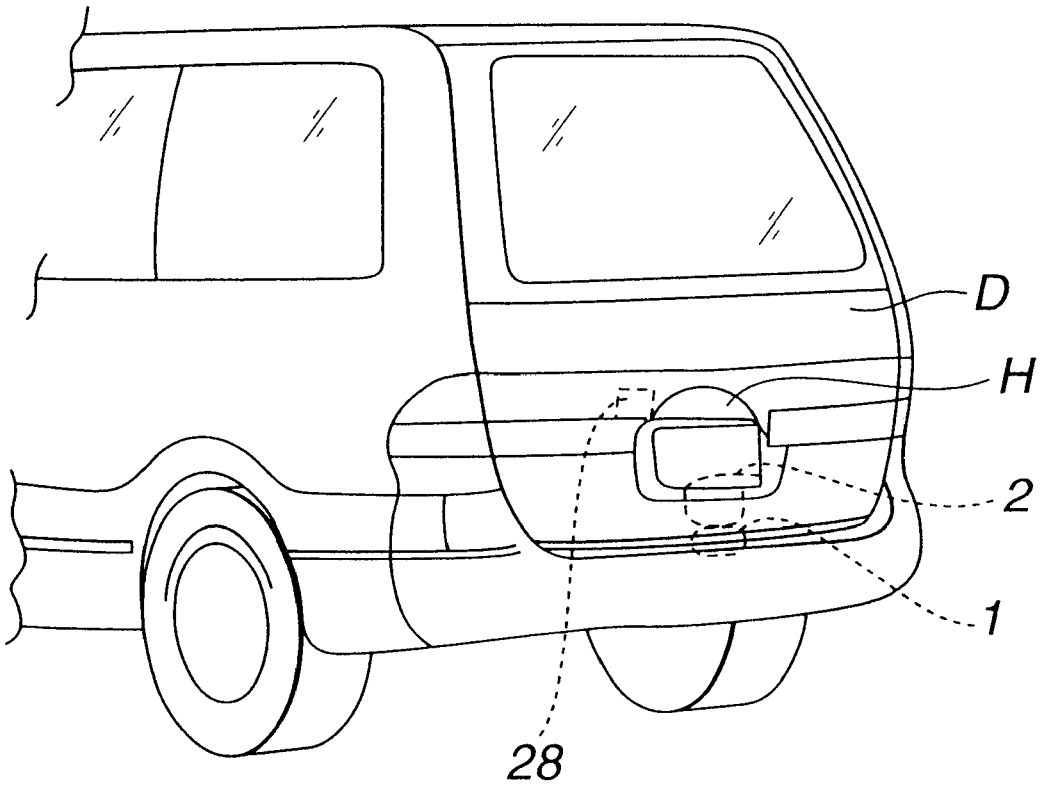
FIG. 1 is a rear view of a motor vehicle to which the present invention is practically applied.

Referring to FIG. 1, there is shown a rear portion of a motor vehicle, to which the present invention is practically applied.

In the drawing, denoted by reference "D" is a back door that is pivotally connected at its upper end to a rear upper end of a vehicle body through hinges. A lock device 1 is mounted to a lower end of the back door "D". As will be described hereinafter, when the back door "D" is pivoted down to assume a close position as shown in the drawing, the lock device 1 is brought into engagement with a striker 5 (see FIG. 8) secured to the vehicle body, so that the back door "D" is locked at a full-closed position.

Figure 2:
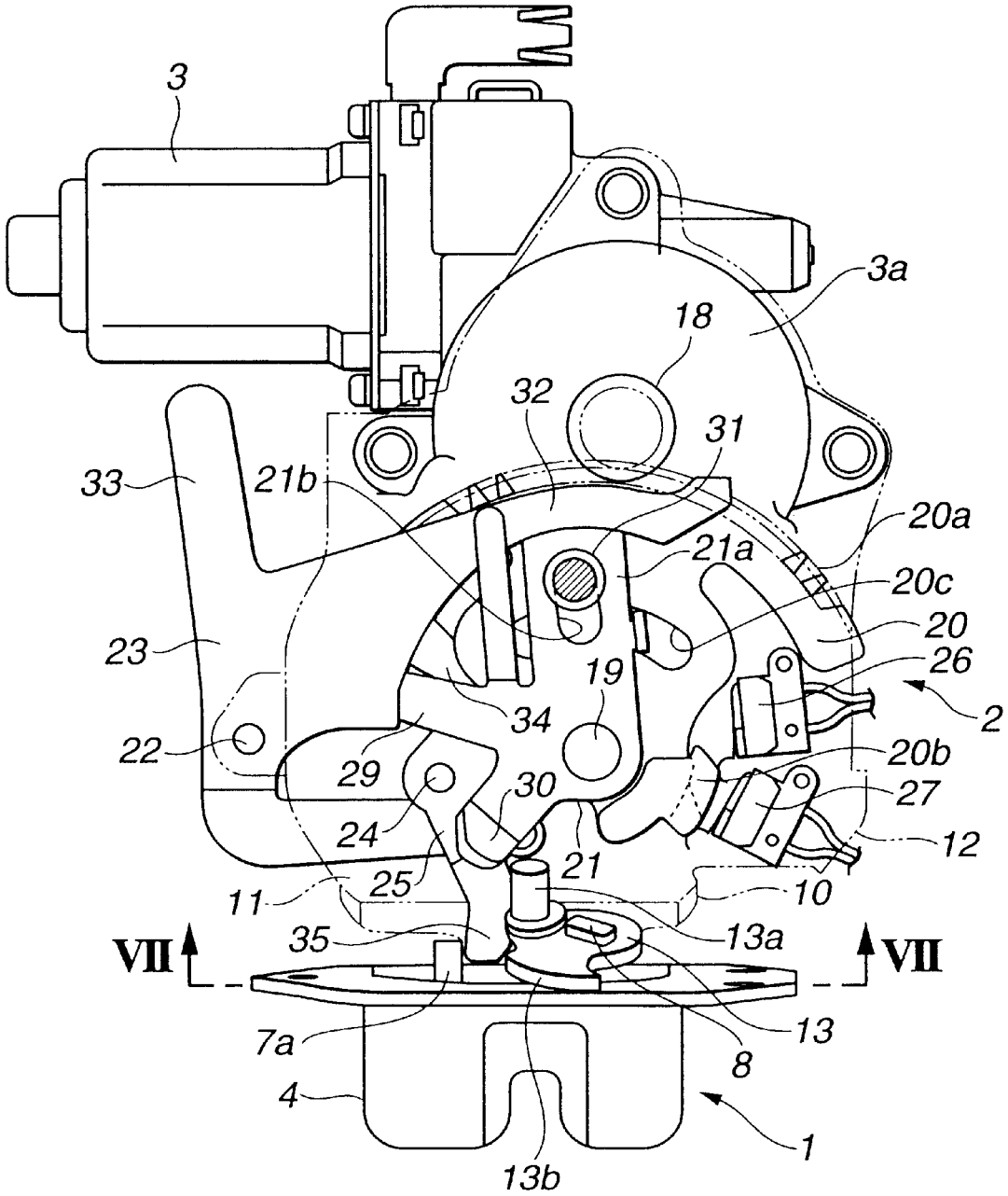
FIG. 2 is a front view of an electric door lock device of the present invention, showing a close lever placed in a neutral position.

Denoted by reference 2 is a drive device that is mounted to the back door "D" to drive or actuate the lock device 1 with an aid of an electric reversible motor 3 (see FIG. 2). That is, the drive device 2 has a closure mechanism that enforcedly shifts the lock device 1 from a half-latch position to a full-latch position, an opening mechanism that enforcedly cancels an engagement between the lock device 1 and the striker 5 and a canceling mechanism that enforcedly cancels the closure mechanism.

It is to be noted that FIGS. 2 to 6 are views taken from a front of the vehicle.

As is seen from FIGS. 7 to 10, the lock device 1 comprises a body 4. Within the body 4, there are pivotally arranged a latch plate 6 and a locking plate 7 through respective pivot shafts 8 and 9. The latch plate 6 is formed with first and second pawl portions 6*a* and 6*b* with which the locking plate 7 is engageable. It is to be noted that the pivot shafts 8 and 9 extend substantially vertically with respect to the vehicle body.

Figure 7:
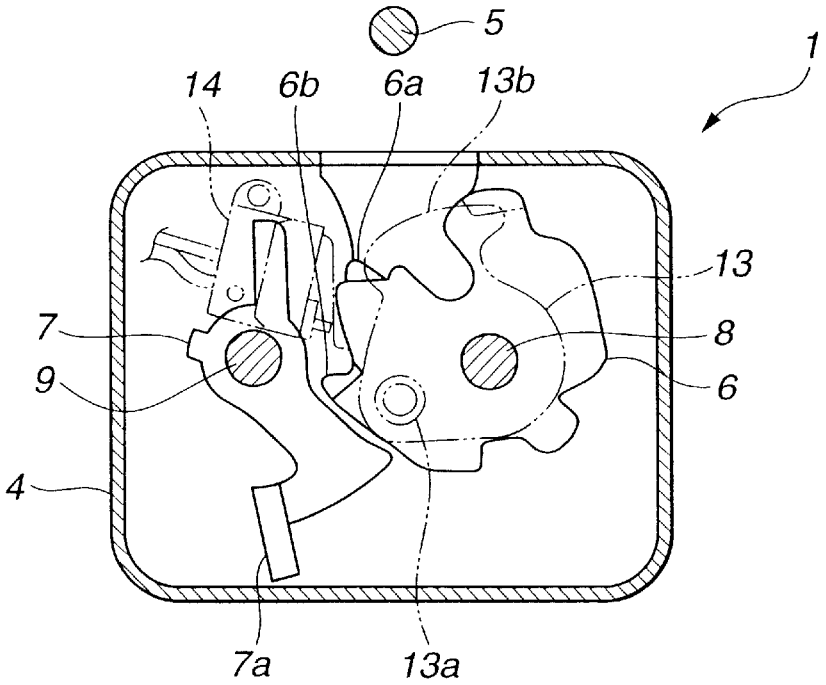
FIG. 7 is a sectional view taken along the line VII—VII of FIG. 2, showing an open condition of a lock device.
Figure 8:
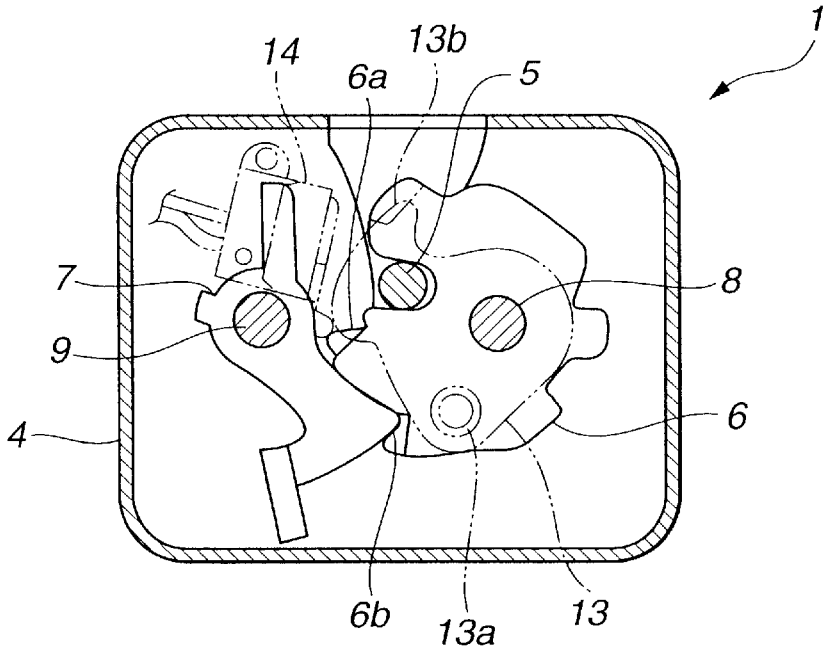
FIG. 8 is a view similar to FIG. 7, but showing a half-latch condition of the lock device.
Figure 9:
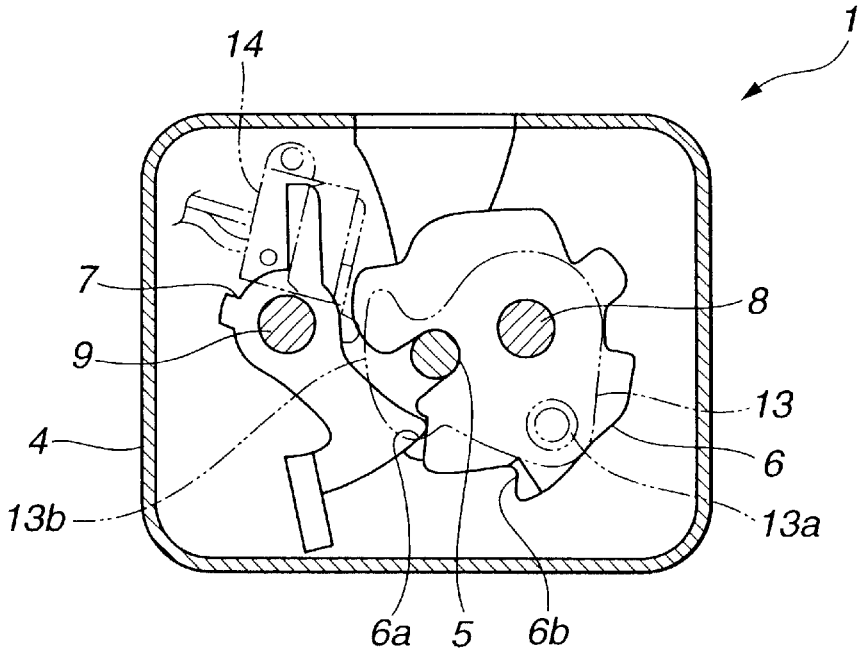
FIG. 9 is a view similar to FIG. 7, but showing a full-latch condition of the lock device.
Figure 10:
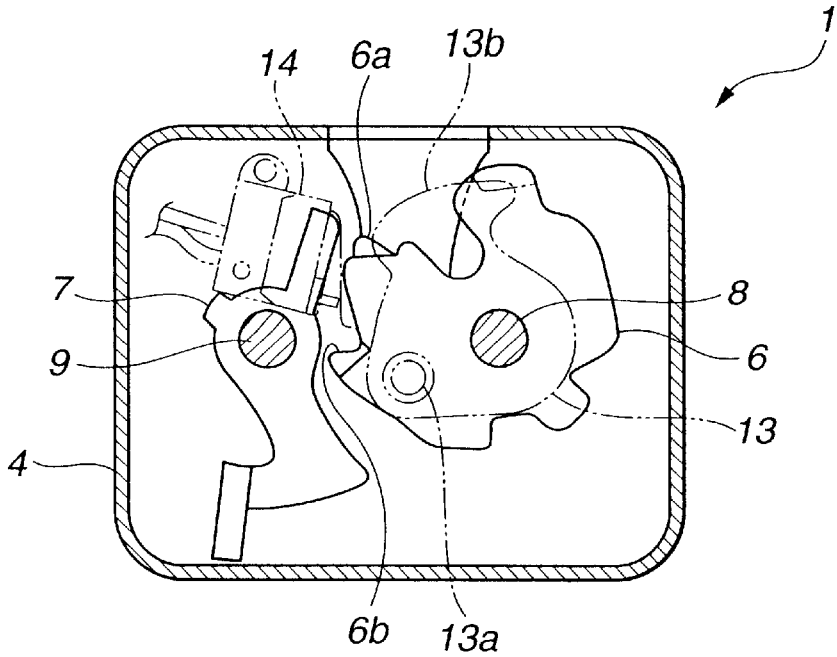
FIG. 10 is view similar to FIG. 7, but showing a locking plate placed in an open position.

The latch plate 6 is pivotal to assume a full-latch position wherein as shown in FIG. 9, it is fully engaged with the striker 5, a half-latch position wherein as shown in FIG. 8, it is halfly or incompletely engaged with the striker 5 and an open position wherein as shown in FIG. 7, it is completely disengaged from the striker 5.

The locking plate 7 is biased in a counterclockwise direction in FIG. 9 by a spring (not shown). That is, when the latch plate 6 assumes the full-latch position of FIG. 9, the locking plate 7 is able to engage with the first pawl portion 6*a*, and when the latch plate 6 assumes the half-latch position of FIG. 8, the locking plate 7 is able to engage with the second pawl portion 6*b*. With such engagement, a clockwise pivoting of the latch plate 6, that is, pivoting in a direction to release the striker 5 is suppressed. As is seen from FIG. 10, the locking plate 7 has further an open position to completely release the first and second pawl portions 6*a* and 6*b* of the latch plate 6.

As is seen from FIG. 2, the body 4 of the lock device 1 has a base plate 10 secured thereto. The base plate 10 generally comprises a horizontal cover portion 11 that generally covers an upper surface of the body 4 and a vertical base portion 12 that extends vertically from a rear end of the cover portion 11.

Above the horizontal cover portion 11, there is arranged a cam lever 13 that is fixed to an upwardly extending end of the latch shaft 8 to rotate together with the latch plate 6. The cam lever 13 has at its leading end an engaging pin 13*a* that extend upward and the cam lever 13 has at its enlarged peripheral part an cam portion 13*b*.

As is understood from FIGS. 2 and 7, on the cover portion 11, there is further arranged a half-latch switch 14 which detects the half-latch position of the latch plate 6 by contacting with the cam portion 13*b* of the cam, lever 13. The half-latch switch 14 is of a normally close switch that assumes ON condition when a probe pin thereof is not pressed and assumes OFF condition when the probe pin is pressed.

The half-latch switch 14 is so positioned that it can detect the half-latch position or issue a corresponding signal when, under downward pivoting movement, the back door "D" comes to a position just before the real half-latch position.

As is seen from FIG. 2, the electric reversible motor 3 is mounted to an upper portion of the vertical base portion 12. A speed reduction unit 3*a* is operatively connected to the motor 3, which has an output gear 18.

The drive device 2 comprises a sector gear 20 that is located at the front of the vertical base portion 12 to be pivotally held by a first shaft 19 and has a tooth portion 20*a* meshed with the output gear 18 of the speed reduction unit 3*a*, a close lever 21 that is located at the front of the vertical base portion 12 and also pivotally held by the first shaft 19, a cancel lever 23 that is located at the front of the vertical base portion 12 and pivotally held by a second shaft 22 and an open lever 25 that is located at the back of the vertical base portion 12 and pivotally held by a third shaft 24.

On the front surface of the vertical base portion 12, there are mounted a close detecting switch 26 that detects a close position of the sector gear 20 and an open detecting switch 27 that detects an after-mentioned open position of the sector gear 20. To a peripheral part of the sector gear 20, there is fixed a cam member 20*b* that is engageable with the close and open detecting switches 26 and 27 when the sector gear 20 turns. The close and open detecting switches 26 and 27 are of a normally close switch that assumes ON condition when a probe pin thereof is not pressed and assumes OFF condition when the probe pin is pressed.

The electric reversible motor 3 is controlled to run in a reversed direction when an outside handle switch 28 (see FIG. 1) assumes an inoperative position and both the close and open detecting switches 26 and 27 assume the operative positions. The outside handle switch 28 is also of a normally close switch that assumes ON condition when a probe pin thereof is not pressed and assumes OFF condition when the probe pin is pressed. The inoperative position of the outside handle switch 28 is made when a handle "H" mounted on an outer surface of the back door "D" is left untouched, and the operative positions of the close and open detecting switches 26 and 27 are made when they are actuated by the cam member 20*b* on the sector gear 20.

When the half-latch switch 14 and the close and open detecting switches 26 and 27 are actuated to assume the operative positions, the motor 3 is controlled to run in a normal direction. When both the close and open detecting switches 26 and 27 are actuated to take the inoperative positions, the motor 3 is controlled to run in the reversed direction. And, when both the close and open detecting switches 26 and 27 are actuated to assume the operative positions, the motor 3 is controlled to stop its running.

As is seen from FIG. 2, the sector gear 20 has an arcuate opening 20*c* that is concentric with the first shaft 19. As is not shown in the drawing, the arcuate opening 20*c* is formed at a middle portion thereof with an upwardly projected recess. Usually, as shown in FIG. 2, the sector gear 20 assumes a neutral position wherein both the close and open detecting switches 26 and 27 are in the operative positions contacting with the cam member 20*b*. From this neutral position, the sector gear 20 is forced to turn clockwise, that is, in an open direction, or counterclockwise, that is, in a close direction in response to the normal or reversed rotation of the motor 3.

The close lever 21 comprises an upwardly extending arm portion 21*a* that has a switching opening 21*b* mating with the arcuate opening 20*c* of the sector gear 20, an open arm portion 29 that extends leftward along the open lever 25 having the vertical base portion 12 interposed therebetween and has at a leading end thereof a pin 29*a* (see FIG. 3) projected rearward, and a raised portion 30 that extends obliquely downward toward the body 4. Usually, the close lever 21 turns together with the sector gear 20 like a single unit. That is, from the neutral position, the close lever 21 turns clockwise (viz., in an open direction) or counterclockwise (viz., in a close direction) together with the sector gear 20.

When the close lever 21 turns in the close direction from the neutral, the raised portion 30 of the same is brought into engagement with the engaging pin 13*a* of the cam lever 13 thereby to shift the latch plate 6 from the half-latch position to the full-latch position.

A flanged switching pin 31 is slidably mated with both the arcuate opening 20*c* of the sector gear 20 and the switching opening 21*b* of the close lever 21. Of course, as is understood from FIG. 2, the switching pin 31 can be put into the upwardly projected recess (not shown) of the arcuate opening 20*c*.

As is seen from FIG. 2, due to force of a spring (not shown), the switching pin 31 is constantly biased upward. Thus, when the sector gear 20 and the close lever 21 take the positions as shown in this drawing, the switching pin 31 is forced to abut against an upper end of the switching opening 21*b* while being put in the upwardly projected recess of the arcuate opening 20*c*. That is, when the switching pin 31 is in this connecting position, turning of the sector gear 20 induces an integral turning of the close lever 21. While, when the switching pin 31 is pushed down by an arm portion 32 of the cancel lever 23 and assumes a lower or cancel position of the switching opening 21*b*, the switching pin 31 is disengaged from the upwardly projected recess. Thus, in this condition, the sector gear 20 and the close lever 21 can turn independently.

The arm portion 32 of the cancel lever 23 is shaped arcuate and concentric with the first shaft 19. As shown, the arm portion 32 extends above the arcuate opening 20*c* of the sector gear 20. The cancel lever 23 has further an upwardly extending control portion 33. The cancel lever 23 is pivotal about the second shaft 22 between a release position wherein as shown in the drawing the arm portion 32 releases the switching pin 31 and a cancel position wherein the arm portion 32 pushes down the switching pin 31 to cause the same to take the cancel position. Although not shown in the drawing, a biasing spring is connected to the cancel lever 23 to bias the same in a counterclockwise direction to assume the release position.

The control portion 33 of the cancel lever 23 is placed in a position that is usually closed by a lid detachably fitted to an inner panel of the back door "D". Thus, if the lid is removed, the control portion 33 can be handled by an operator from the outside of the vehicle.

Figure 6:
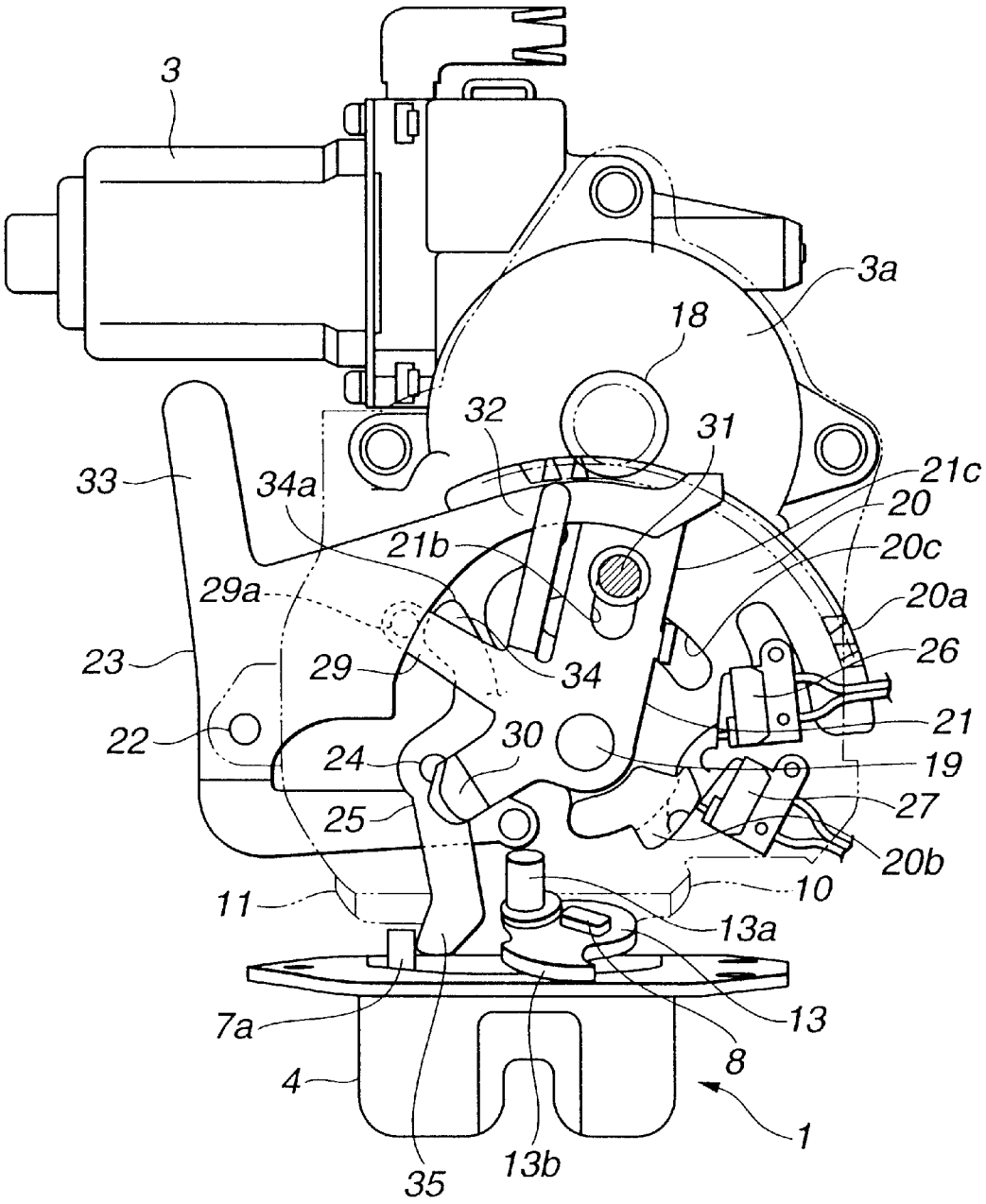
FIG. 6 is a view similar to FIG. 2, but showing an open lever placed in an open position.

As is well seen from FIG. 6, the open lever 25 comprises an upwardly extending engaging arm 34 that is engageable with the pin 29*a* of the close lever 21 when the close lever 21 is turned in the open direction and a downwardly extending opening arm 35 that is contactable with a projection 7*a* of the locking plate 7.

Usually, due to a force of a biasing spring (not shown), the open lever 25 assumes a stand-by position as shown in FIG. 2. While, when the open lever 25 is pivoted about the third shaft 24 in a clockwise direction against the biasing spring, the opening 35 of the open lever 25 pushes the projection leftward thereby to turn the locking plate 7 in the open direction.

When the close lever 21 is turned from the neutral position toward the open position (viz., clockwise in FIG. 2), the pin 29*a* (see FIG. 3) becomes in sliding contact with the engaging arm 34 of the open lever 25 thereby turning the open lever 25 from the stand-by position in the open direction. As is seen from FIG. 6, once the open lever 25 has come to the open position, the engaging arm 34 is disengaged from the traveling path of the of the pin 29*a* and the pin 29*a* is forced to slide along a peripheral edge 34*a* of the engaging arm 34. With this movement, an air striking movement of the close lever 21 in the open direction is permitted having the open lever 25 kept in the open position.

It is to be noted that the peripheral edge 34*a* of the engaging arm 34 of the open lever 25 is shaped arcuate. That is, when the open lever 25 is in the open position, the peripheral edge 34*a* shows that arcuate shape that is concentric with the first shaft 19. With this arrangement, during the time when the close lever 21 is making the air striking movement, the open lever 25 can be assuredly kept in the open position.

Accordingly, even if, just after stopping of the motor 3 due to the detecting work of the open detecting switch 27, the close lever 21 is forced to move beyond the open position due to an inertial force and the like, the exceeded moved distance of the close lever 21 is not transmitted to the open lever 25. Thus, undesired deformation and damage of the open lever are suppressed.

Figure 11:
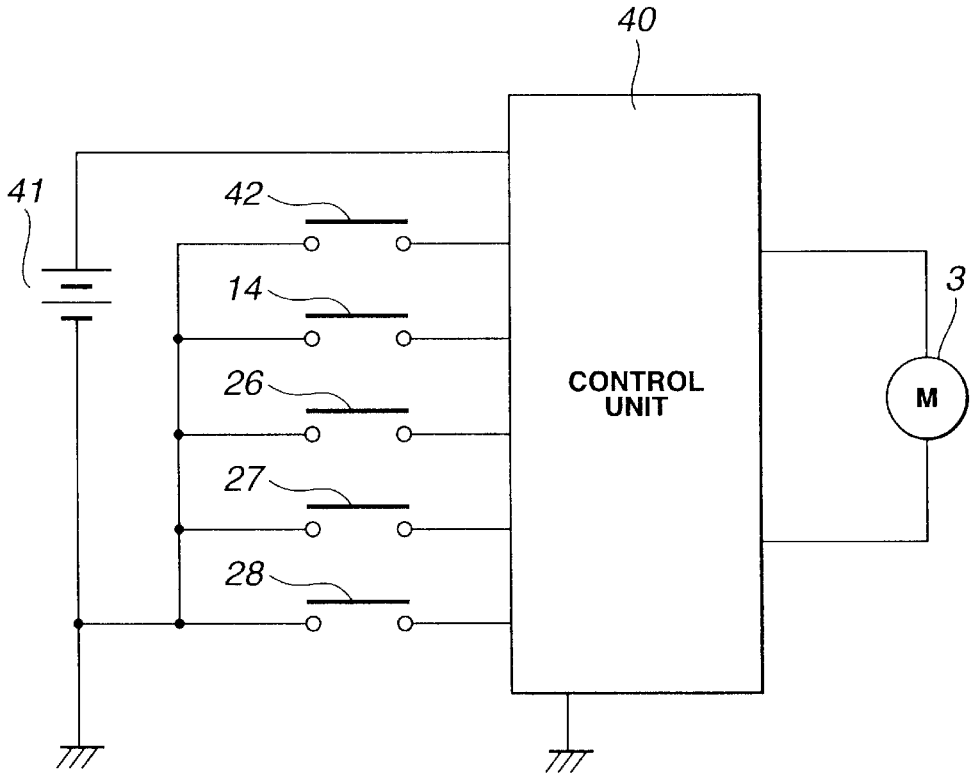
FIG. 11 is a schematic view of an electric circuit employed in the present invention.

Referring to FIG. 11, there is schematically shown an electric circuit employed in the control system of the present invention.

In the drawing, denoted by numeral 40 is a control unit comprising a micro-computer which generally includes a central processing unit (CPU), a random access memory (RAM), a read only memory (ROM) and input and output interfaces. Denoted by numeral 41 is a battery whose positive and negative terminals are connected to corresponding terminals of the control unit 40. The negative terminals are earthed.

As shown, between the negative terminal of the battery 41 and input terminals of the control unit 40, there are arranged a lock switch 42, the half-latch switch 14, the close detecting switch 26, the open detecting switch 27 and the outside handle switch 28.

It is to be noted that the lock switch 42 is incorporated with an inside lock knob (not shown) that can inhibit opening of a side door. That is, when the lock switch 42 is in its operative position, the closure mechanism and opening mechanism of the drive device 2 are inoperative.

The control unit 40 has output ports to which the electric motor 3 is connected. Although not shown in the drawing, a normal rotation relay for achieving a normal rotation of the motor 3 and a reversed rotation relay for achieving a reversed rotation of the motor 3 are arranged between the output ports and the motor 3, so that the control unit 40 forces the motor 3 to run in normal or reversed direction in accordance with operation of the switches 42, 14, 26, 27 and 28.

In the following, operation of the electric door lock device of the present invention will be described with reference to the time chart of FIG. 12 and flowcharts of FIGS. 13 and 14.

Closing Operation

When the back door "D" is in an open position, the lock device 1 and drive device 2 assume such conditions as shown by FIGS. 2 and 7 respectively. This condition appears at the zone "half-open" in the time chart of FIG. 12. That is, under this condition, the close detecting switch 26 and open detecting switch 27 are in their neutral position, and the half-latch switch 14 is in its inoperative position.

Figure 3:
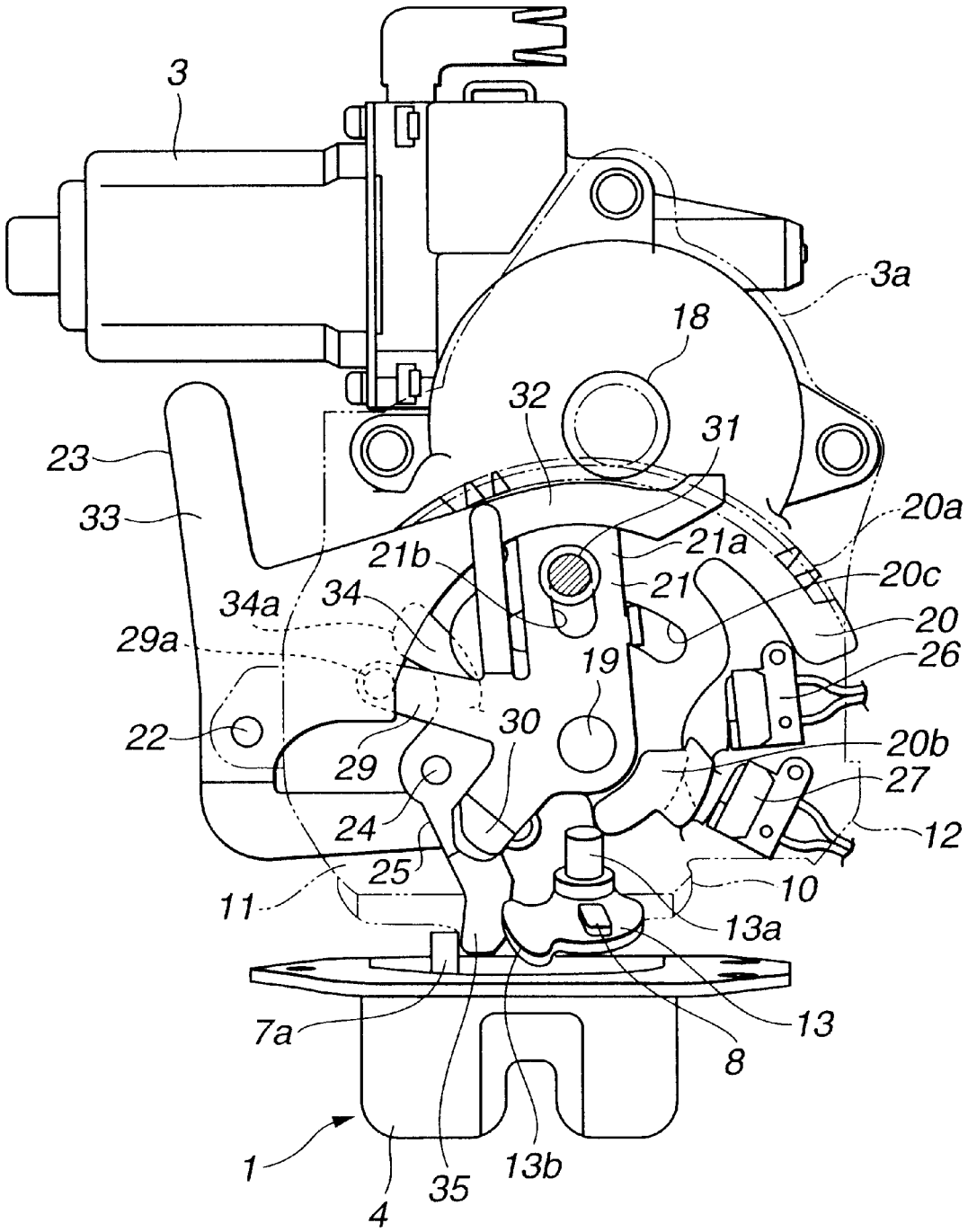
FIG. 3 is a view similar to FIG. 2, but showing a latch plate placed in a half-latch position.
Figure 4:
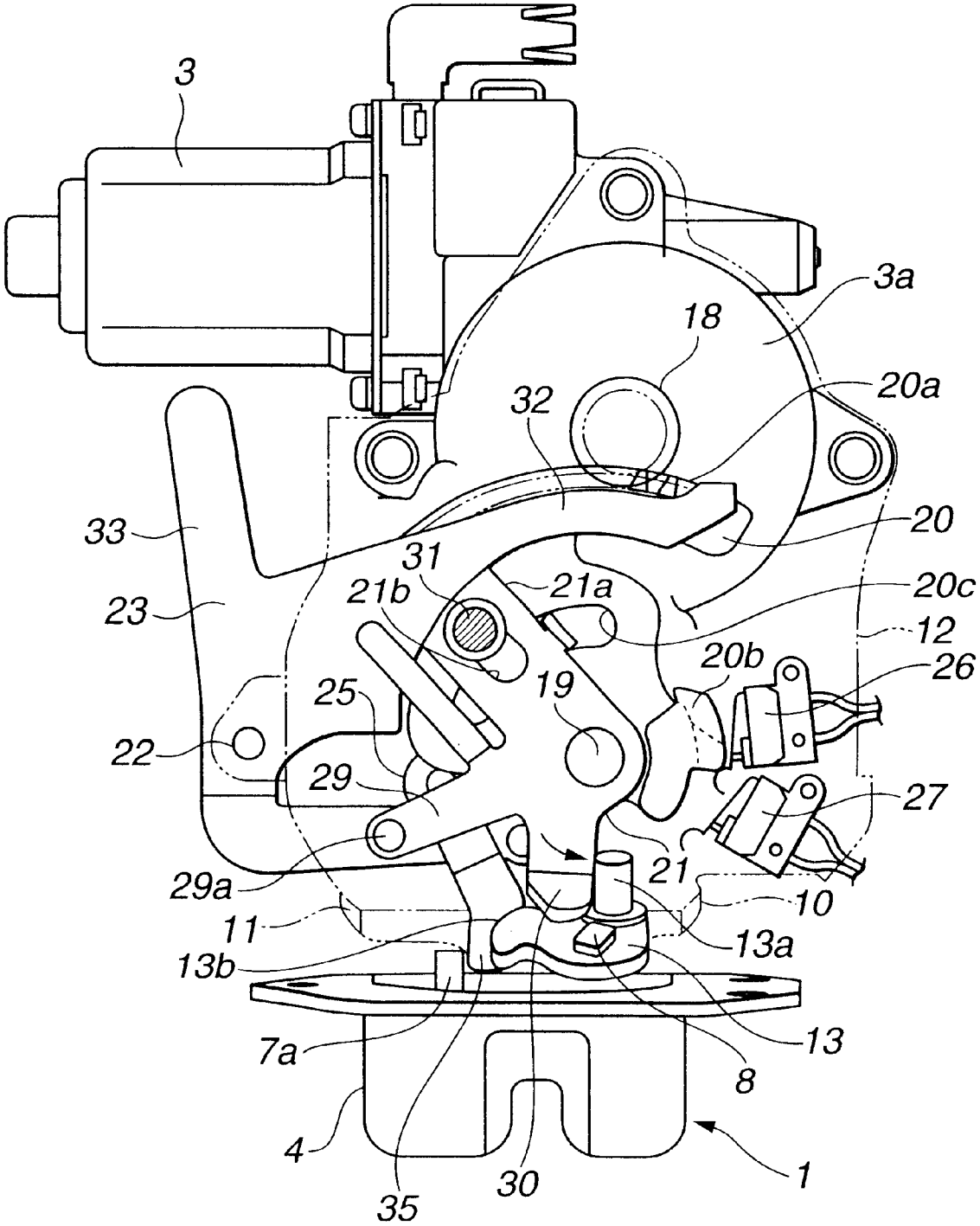
FIG. 4 is a view similar to FIG. 2, but showing the close lever placed in a close position.

When the back door "D" is pulled down to the close position, a closing mode (see FIG. 13) starts. That is, upon this, the latch plate 6 of the lock device 1 is engaged with the striker 5 and pivoted from the open position to the half-latch position as shown in FIGS. 3 and 8. This condition brings about YES to step S1 of the flowchart of FIG. 13. That is, the condition for starting the closure mechanism of the drive device 2 is established and appears at the zone-① in the time chart of FIG. 12. When the half-latch switch 14 detects movement of the latch plate 6 to the half-latch position through the cam lever 13, the normal rotation relay becomes ON to turn the motor 3 in a normal direction. This operation is depicted in step S1-1 of the flowchart of FIG. 13. With this, the sector gear 20 and the close lever 21 are pivoted in the close direction (viz., counterclockwise in FIG. 2).

Upon this close pivoting of the close lever 21, the raised portion 30 of the close lever 21 is bought into abutment with the engaging pin 13*a* of the cam lever 13 thereby to enforcedly shift the latch plate 6 from the half-latch position to the full-latch position. With this operation, the back door "D" is brought from a half-door position to a full-close position. This condition appears at the zone-② in the time chart of FIG. 12. Just after the movement of the sector gear 20, the open detecting switch 27 assumes the inoperative position and the close detecting switch 26 is kept at the operative position.

When the close detecting switch 26 is shifted to the inoperative position due to disengagement from the cam member 20*b* of the sector gear 20, and thus when both the close and open detecting switches 26 and 27 both assume the inoperative position, the full-latch position of the latch plate 6 is recognized and the normal rotation relay becomes OFF to stop the motor 3. This operation is depicted in steps S2 and S2-1 of the flowchart of FIG. 13 and appears at the zone-③ in the time chart of FIG. 12.

When then the reversed rotation relay becomes ON, the motor 3 is controlled to run in a reversed direction. Upon this, the sector gear 20 and the close lever 21 are turned clockwise toward the neutral position. This operation is depicted in steps S3 and S3-1 of the flowchart of FIG. 13 and appears at the zone-④ in the time chart of FIG. 12. Just after the back turning of the sector gear 20, the close detecting switch 26 is brought into contact with the cam member 20*b* and thus assumes the operative position, while the open detecting switch 27 is kept at the inoperative position.

When the sector gear 20 is returned to the neutral position, the open detecting switch 27 is brought into contact with the cam member 20*b* of the sector gear 20 and thus assumes the operative position. When detecting that both the close and open detecting switches 26 and 27 are at the neutral position in the operative position, the control unit 40 turns the reversed rotation relay OFF. Upon this, operation of the motor 3 is stopped. This operation is depicted in steps S4 and S4-1 of the flowchart of FIG. 13 and appears at the zone "half close" in the time chart of FIG. 12.

Opening Operation

Figure 5:
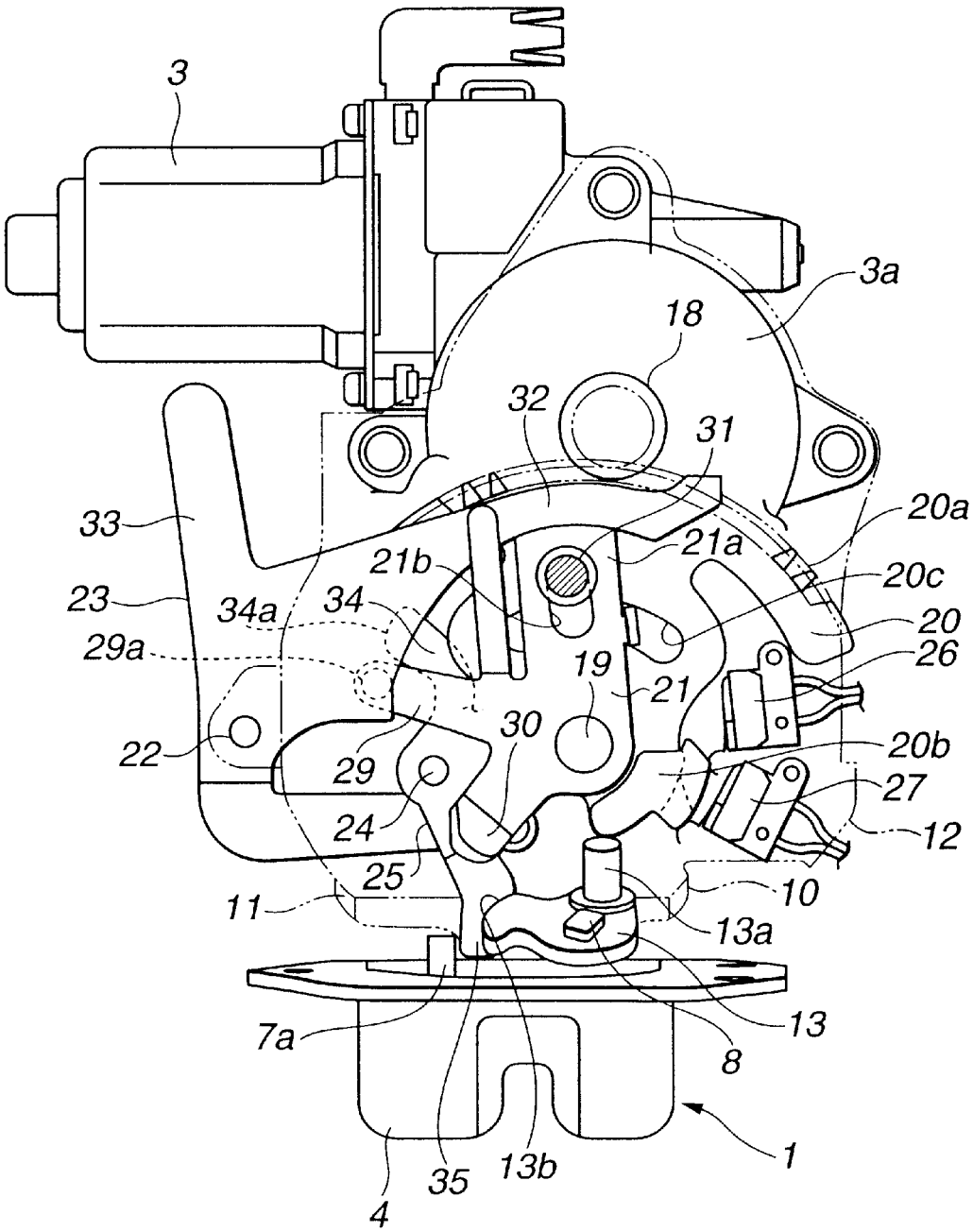
FIG. 5 is a view similar to FIG. 2, but showing the latch plate placed in a full-latch position.

When the back door "D" is in the close position, the drive device 2 assumes the condition as shown in FIG. 5. That is, under this condition, both the sector gear 20 and the close lever 21 assume their neutral position and the switching pin 31 is in the connecting position, so that the sector gear 20 and the close lever 21 are united to operate as a single unit. Furthermore, as is seen from FIG. 9, the latch plate 6 assumes the full-latch position having the locking plate 7 engaged with the first pawl portion 6*a* thereof. This condition appears at the zone "half-close" in the time chart of FIG. 12. That is, the close and open detecting switches 26 and 27 are both in contact with the cam member 20*b* of the sector gear 20 and thus assume their neutral position in the operative position.

Figure 14:
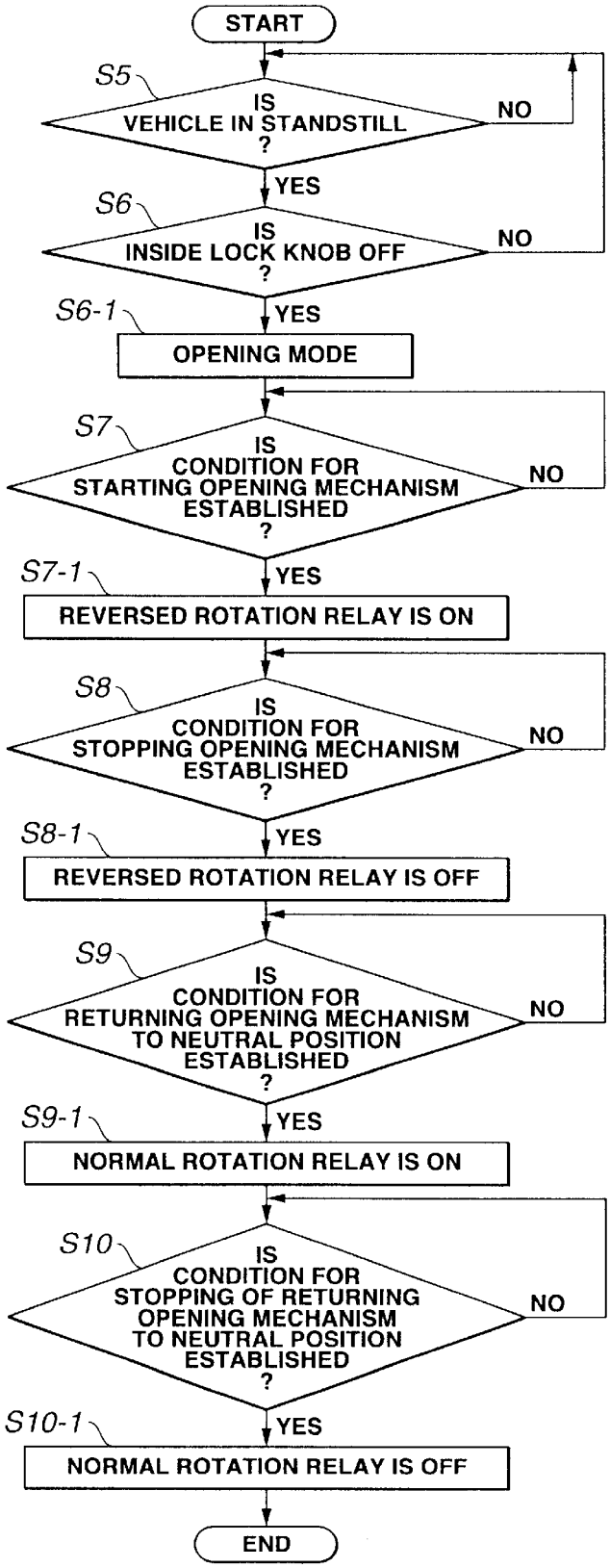
FIG. 14 is a flowchart showing operation steps carried out by the control unit for controlling an opening mechanism.

Step S5 of the flowchart of FIG. 14 is used for checking whether the vehicle is in a standstill or not in a case of intending starting of opening operation. This step S5 may be carried out by judging whether the vehicle speed is 0 (zero) or not, the shift lever is at the parking position or not, or the parking brake is kept actuated or not. When it is judged YES, that is, when the vehicle is judged to be in a standstill, the operation flow goes to step S6. At this step S6, for anti-thief intention, judgment is carried out as to whether the lock switch 42 has been actuated or not, that is, whether the inside lock knob of each side door has been handled or not. If it is judged that the lock switch 42 has not been actuated, that is, it is judged that the inside lock knob has not been handled, the operation flow goes to step S6-1 to start an opening mode.

When now the handle "H" of the back door "D" is manipulated, the outside handle switch 28 comes to an inoperative position, and thus the reversed rotation relay becomes ON. With this, the motor 3 is forced to run in a reversed direction causing the sector gear 20 and the close lever 21 to turn in the opening direction (viz., clockwise in FIG. 5) from the neutral position. During this, as is understood from FIG. 6, the switching pin 31 moves rightward, and at the same time, the pin 29*a* of the close lever 21 pushes the engaging arm 34 of the open lever 25 rightward to the open position as shown in the drawing. This operation is depicted in steps S7 and S7-1 of the flowchart of FIG. 14 and appears at the zone-⑤ in the time chart of FIG. 12. The close detecting switch 26 is disengaged from the cam member 20*b* of the sector gear 20 to assume the inoperative position, and the open detecting switch 27 is kept in contact with the cam member 20*b* and thus kept at the operative position.

When the open lever 25 is moved to the open position, the engaging arm 34 is disengaged from the traveling path of the pin 29*a* and suppressed from making further movement, and at the same time, the opening arm 35 is pushed against a projection 7*a* of the locking plate 7 thereby to pivot the locking plate 7 to its open position. With this, engagement between the latch plate 6 and the locking plate 7 becomes cancelled thereby to permit opening of the back door "D". This operation is depicted in step S8 of the flowchart of FIG. 14. If YES in this step, that is, if a condition for stopping the opening operation is established, the operation flow goes to step S8-1 to turn the reversed rotation relay OFF. With this, the motor 3 is stopped. This operation appears at the zone-⑥ in the time chart of FIG. 12. In this zone, the close detecting switch 26 is disengaged from the cam member 20*b* and thus assumes the inoperative position, and thus both the close and open detecting switches 26 and 27 are in the inoperative position.

With the above-mentioned condition kept, the motor 3 is controlled to run in a reversed direction. However, as soon as the close detecting switch 26 assumes the inoperative position due to the disengagement from the cam member 20*b*, a timer 5 (T5) starts a time counting, and for a time "t5" that the timer 5 counts up, the reversed rotation of the motor 3 is suppressed.

Within the time "t5", the engagement between the latch plate 6 and the locking plate 7 is canceled and the half-latch switch 14 becomes inoperative. Upon this, the normal rotation relay is turned ON thereby rotating the motor 3 in the normal direction. With this, the sector gear 20 and the close lever 21 start to return from the open position toward the neutral position. This operation is depicted in steps S9 and S9-1 of the flowchart of FIG. 14. If the timer T5 is not provided, the following undesired phenomenon would take place. That is, even when it is recognized that the locking plate 7 has come to the open position due to appearance of the inoperative position of the close detecting switch 26, operating the motor 3 to run in the reversed direction with the latch plate 6 being insufficiently disengaged from the locking plate 7 induces inevitably re-engagement between the latch plate 6 and the locking plate 7. For avoiding this undesired phenomenon, that is, for obtaining a time in which the engagement is assuredly cancelled, the timer T5 is employed.

When the motor 3 is controlled to run in the reversed direction, the open detecting switch 27 becomes instantly engaged with the cam member 20*b* and thus assumes the operative position. During the movement toward the neutral position, the open detecting switch 27 is kept in the operative position and the close detecting switch 26 is kept in the inoperative position. This operation appears at the zone ⑦ in the time chart of FIG. 12.

When the sector gear 20 is returned back to the neutral position, the open detecting switch 27 is brought into contact with the cam member 20*b* and thus assumes an operative position. Thus, as is seen from FIG. 2, both the close and open detecting switches 26 and 27 assume the operative position. Thus, neutral position of the sector gear 20 is recognized and thus the normal rotation relay is turned OFF to stop the motor 3, and the open lever 25 is returned to the stand-by position by the force of the biasing spring. This operation is depicted in steps S10 and S10-1 of the flowchart of FIG. 14 and appears at the zone "half open" in the time chart of FIG. 12.

Canceling Operation

For example, when, during movement of the sector gear 20 and close lever 21 in the closing direction, the motor 3 is stopped due to failure of the motor 3 or the control unit 40 and thus the sector gear 20 is stopped at the close position, it may occur that the raised portion 30 of the close lever 21 engages with the engaging pin 13*a* of the cam lever 13 thereby to prevent the latch plate 6 from moving toward the open position. In this case, the back door "D" would not be opened. However, in this case, manipulation of the control portion 33 of the cancel lever 23 can solve such undesired phenomenon.

That is, when, due to manipulation of the control portion 33, the cancel lever 23 is pivoted clockwise in FIG. 2 to the cancel position, the arm portion 32 of the cancel lever 23 pushes down the switching pin 31 thereby to shift the same to the cancel position. With this, the integral connection between the sector gear 20 and the close lever 21 becomes canceled. When, under this canceled condition, the close lever 21 is returned to the neutral position, shifting of the latch plate 6 to the open position is permitted. Thus, when, thereafter, a locking plate control device mounted on the back door "D" is manipulated, the locking plate 7 of the lock device 1 is shifted to the open position, which permits the opening movement of the back door "D".

When, with the close lever 21 assuming the open position, the motor 3 fails to run due to the above-mentioned reasons, it may occur that the locking plate 7 is restrained at the open position causing the back door "D" to fail to take the close position. However, also in this case, such undesired phenomenon can be solved by shifting the close lever 21 to the neutral position through the cancel lever 23 for canceling the restraint of the locking plate 7.

The above-mentioned operations are of a basic operation that the control system of the present invention exhibits.

In the following, back-up operations of the control system will be described with the aid of the drawings.

Figure 15:
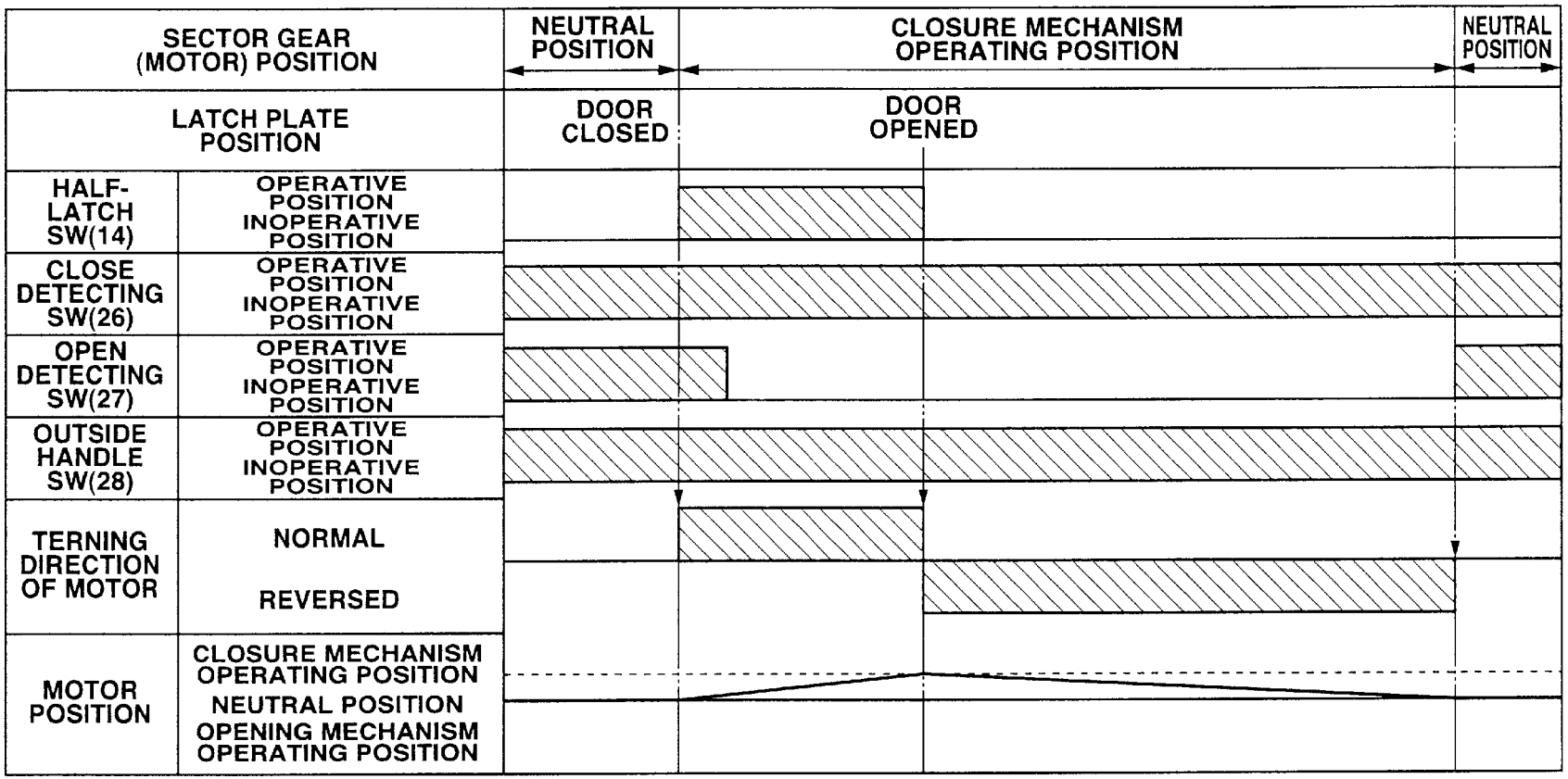
FIG. 15 is a time chart showing an operation of the drive device in case wherein, with the closure mechanism operating to open the back door, a moving member moves away from a neutral position causing a reversed rotation of a motor thereby to cause the lock device to return to a neutral position.
Figure 16:
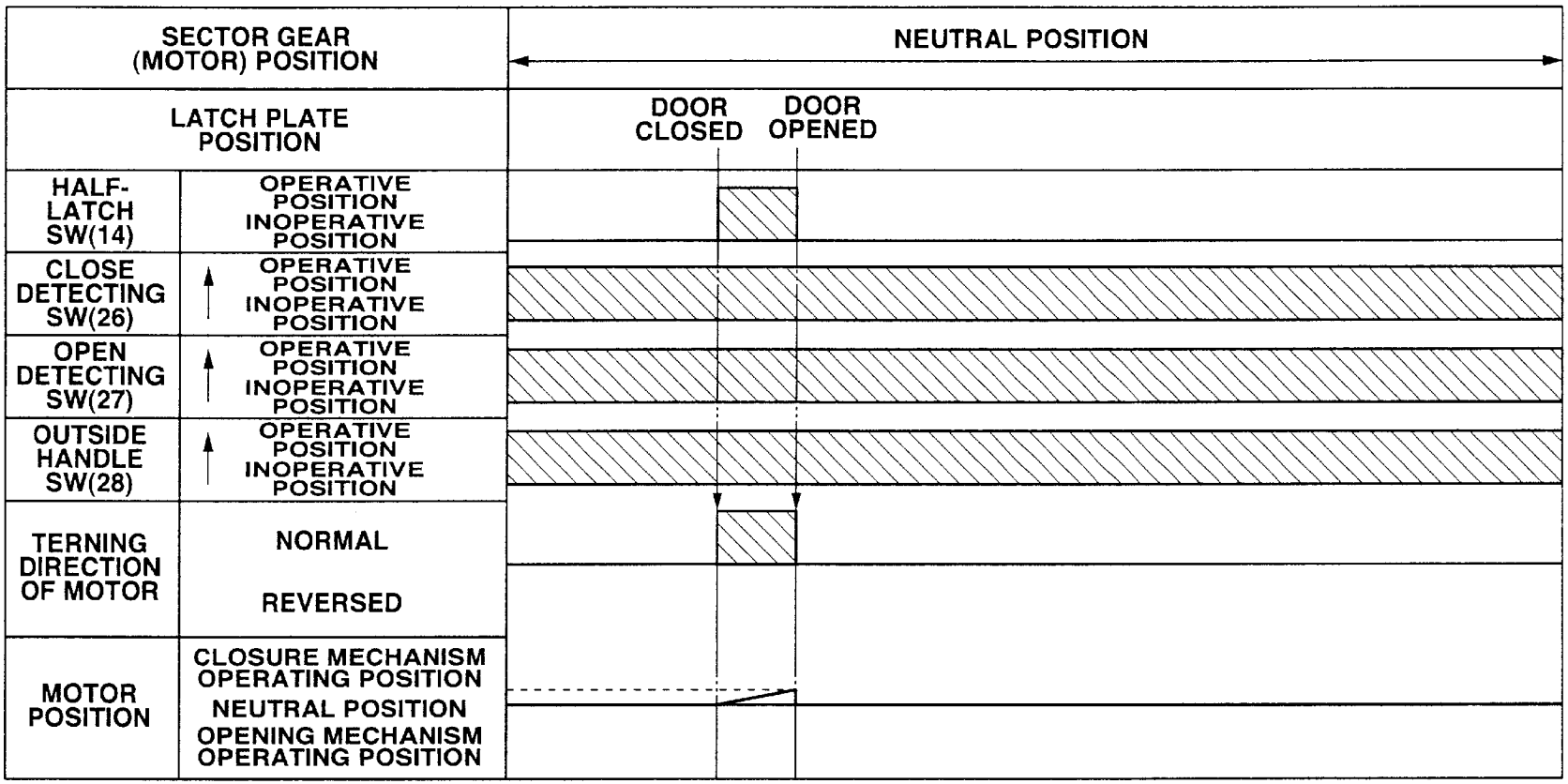
FIG. 16 is a time chart showing an operation of the drive device in case wherein, with the closure mechanism operating to open the back door, the moving member is left in the neutral position causing a stopping of the motor thereby to cause the lock device to stay in the neutral position.

Door Opening Operation Under Operation of Closure Mechanism (see FIGS. 15 and 16)

The closure mechanism of the lock device 1 has the following function. That is, when, during closing movement, the back door "D" passes through a position corresponding to the operative position of the half-latch switch 14 and is given a force in an upward or opening direction at a position just before the half-latch position, the following two operations take place selectively depending on the condition of the sector gear 20. That is, when the sector gear 20 has been kept disengaged from neutral position (see FIG. 15), the second passage of the back door "D" through the operative position of the half-latch switch 14 is detected for running the motor 3 in the reversed direction. With this, the sector gear 20 is turned to the neutral position. While, when the sector gear 20 has been left at the neutral position (see FIG. 16), the motor 3 is instantly stopped for keeping the sector gear 20 at the neutral position. As is described above, when, during closing movement of the back door "D", a manual opening force is applied to the door "D" at a position before the half-latch position, the sector gear 20 is always returned to the neutral position thereby canceling operation of the closure mechanism. Thus, in such case, the lock device 1 can keep its releasing position assuredly.

Switch Failure Back-Up Operation

In the control unit 40, in accordance with operative and inoperative conditions of the close and open detecting switches 26 and 27, the angular position of the sector gear 20 is detected. If, due to any trouble, these switches 26 and 27 fail to send proper information signals to the control unit 40, a normal control of the drive device 2 becomes impossible. When the sector gear 20 is moved from a gear position to the other gear position, one of the switches 26 and 27 issues a so-called "movement completion signal" upon completion of the movement of the gear 20 to the other gear position. That is, when the movement of the sector gear 20 starts, a time elapsed from the starting is counted, and if the switch 26 or 27 does not issue the movement completion signal even when the elapsed time shows a predetermined value, judgment is so made that the switch 26 or 27 has failed to operate. When, due to inoperative condition of the close or open detecting switch 26 or 27, either one of the closure and opening mechanisms fails to operate, the function of the switch 26 or 27 in the movement from the neutral position to the other position is made operative. In the following, various failure cases of the switches will be described.

Failure with Open Detecting Switch Kept in Operative Position

Figure 17:
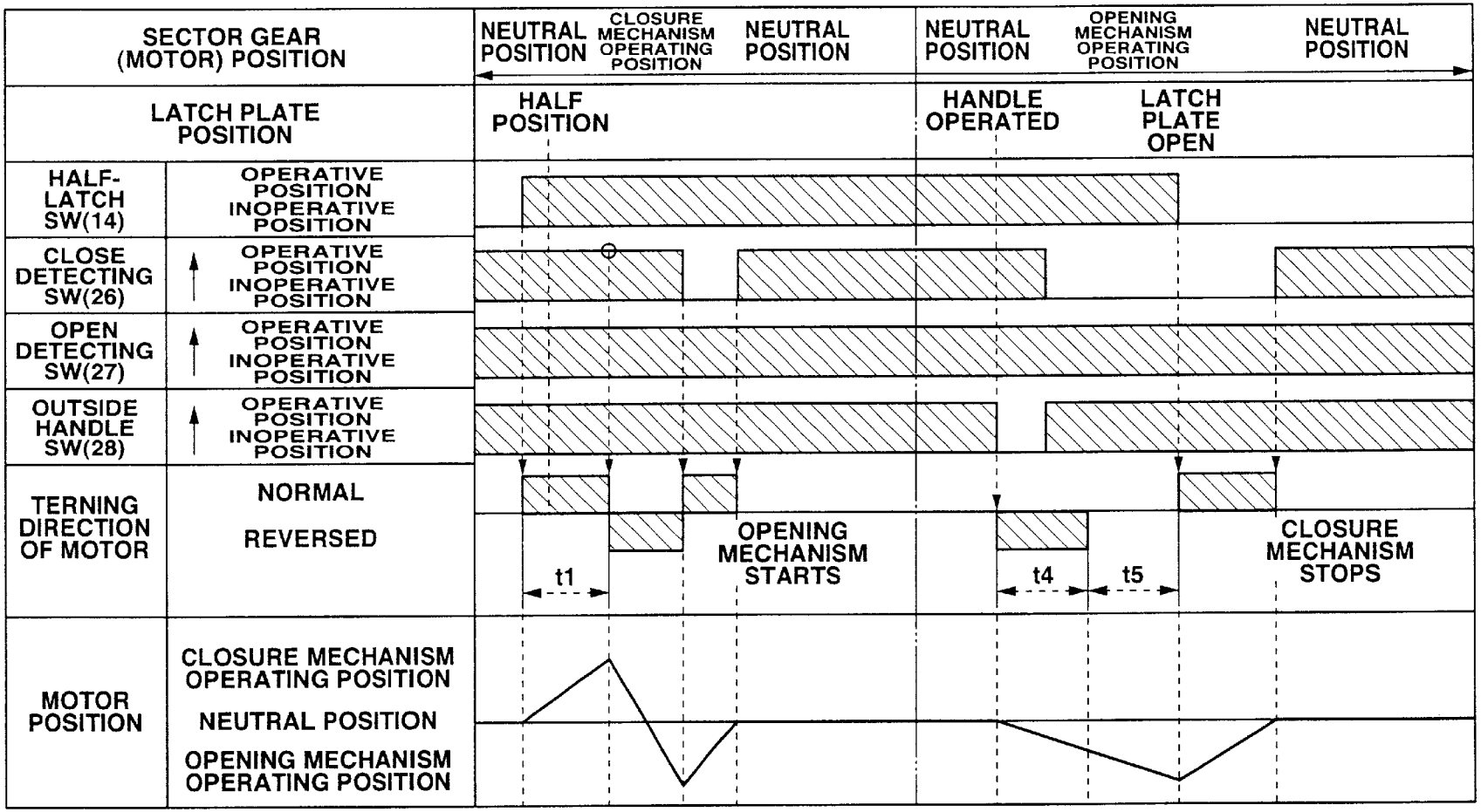
FIG. 17 is a time chart showing a switch failure back-up operation of the drive device in case wherein an open detecting switch fails to assume an operative position.

This failure will be explained with the aid of the time chart of FIGS. 12 and 17. When, in the zone-① of the time chart of FIG. 12, that is, when the open detecting switch 27 does not take its inoperative position within a predetermined time "t1" counted by a timer "T1" from the time when the half-latch switch 14 has assumed its operative condition, the motor 3 is forced to run in a reversed direction upon completion of the time counting by the timer "T1" thereby to cause the close detecting switch 26 to assume the inoperative position, and then, the motor 3 is forced to run in a normal direction to cause the switch 26 to return to the neutral position. When the close detecting switch 26 assumes the operative position, the motor 3 is stopped.

Figure 12:
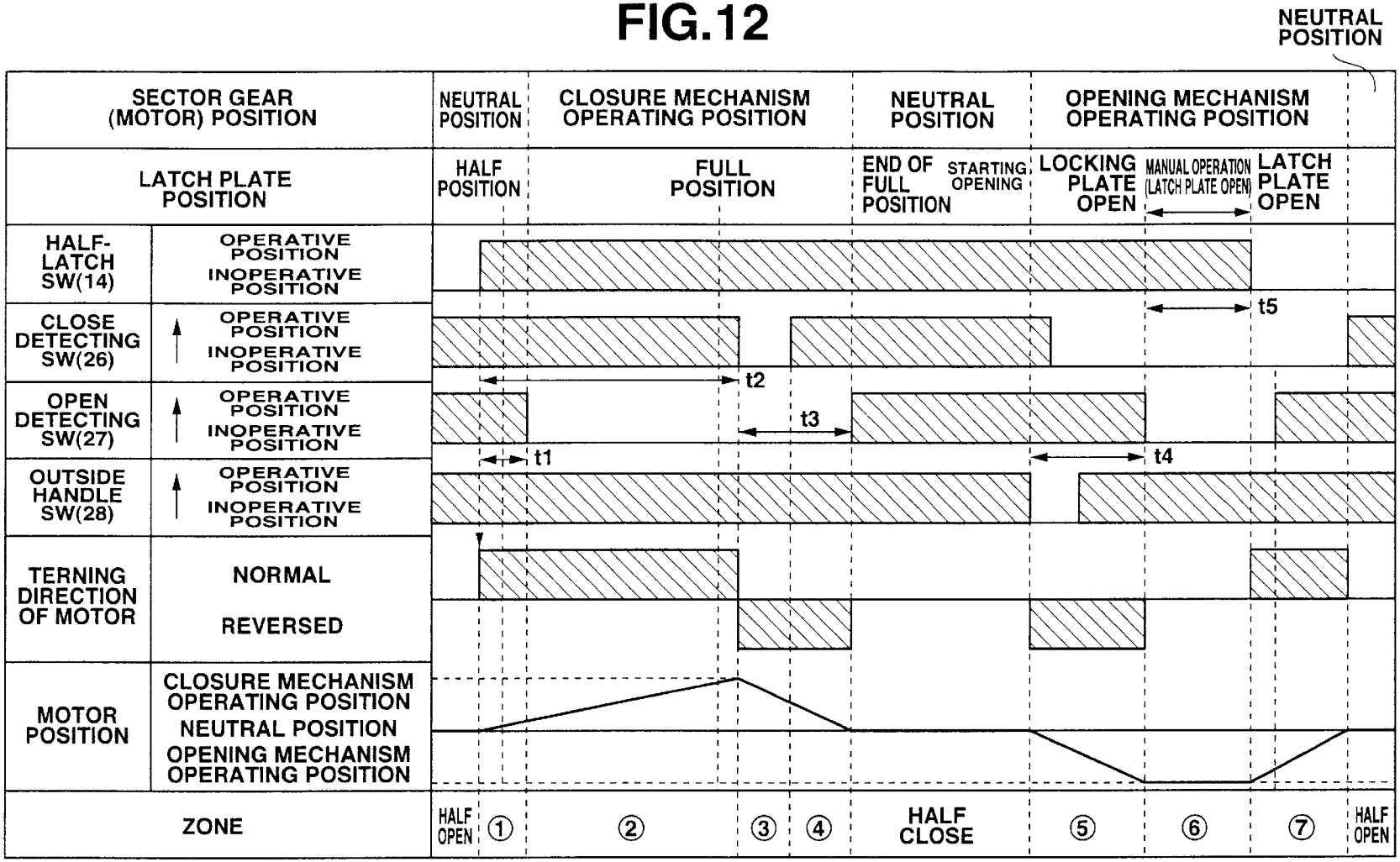
FIG. 12 is a time chart showing a basic operation of a drive device employed in the present invention.
Figure 13:
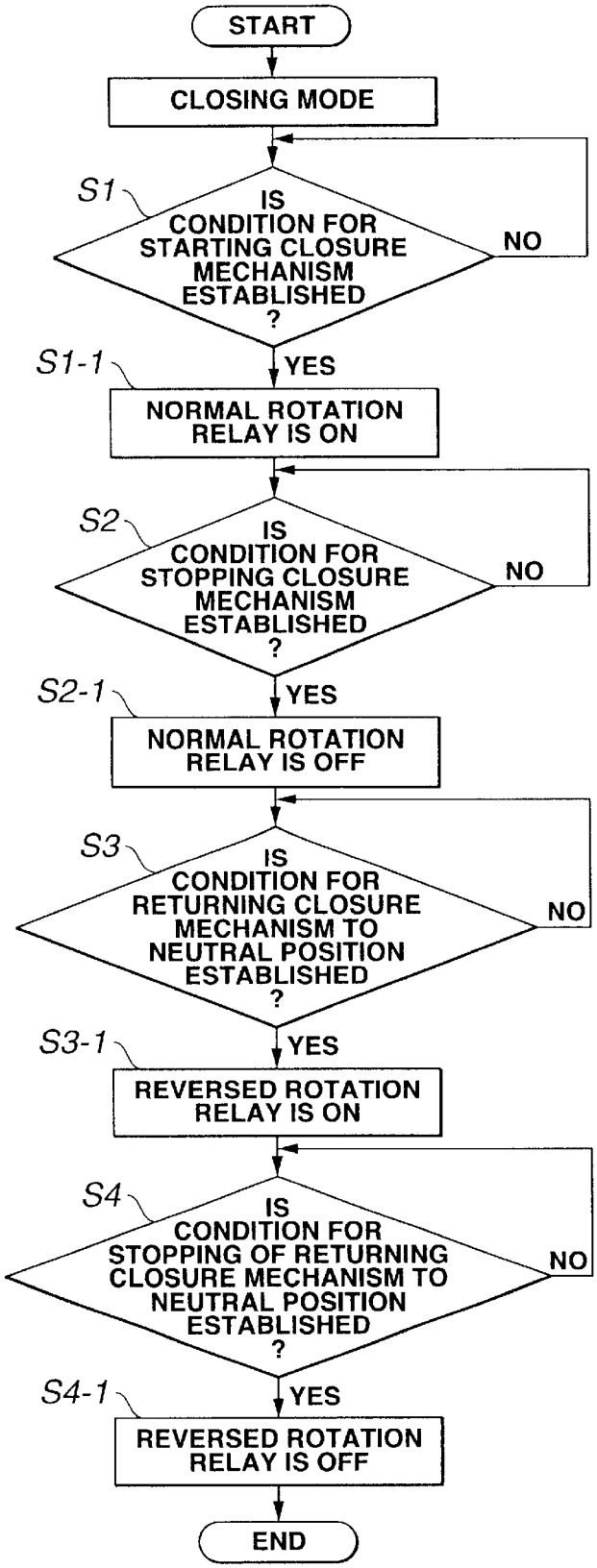
FIG. 13 is a flowchart showing operation steps carried out by a control unit employed in the invention for controlling a closure mechanism.

When, in the zone-⑤ of the time chart of FIG. 12, that is, when the open detecting switch 27 does not take the operative position within a predetermined time "t4" counted by a timer "T4" from the time when the outside handle switch 28 has assumed its inoperative position, the motor 3 is forced to run in a normal direction after having a rest of a given time "t5" upon completion of the time counting by the timer "T5" thereby to cause the outside handle switch to return to the neutral position. When the close detecting switch 26 assumes the operative position, the motor 3 is stopped.

Failure with Open Detecting Switch Kept in Inoperative Position

Figure 18:
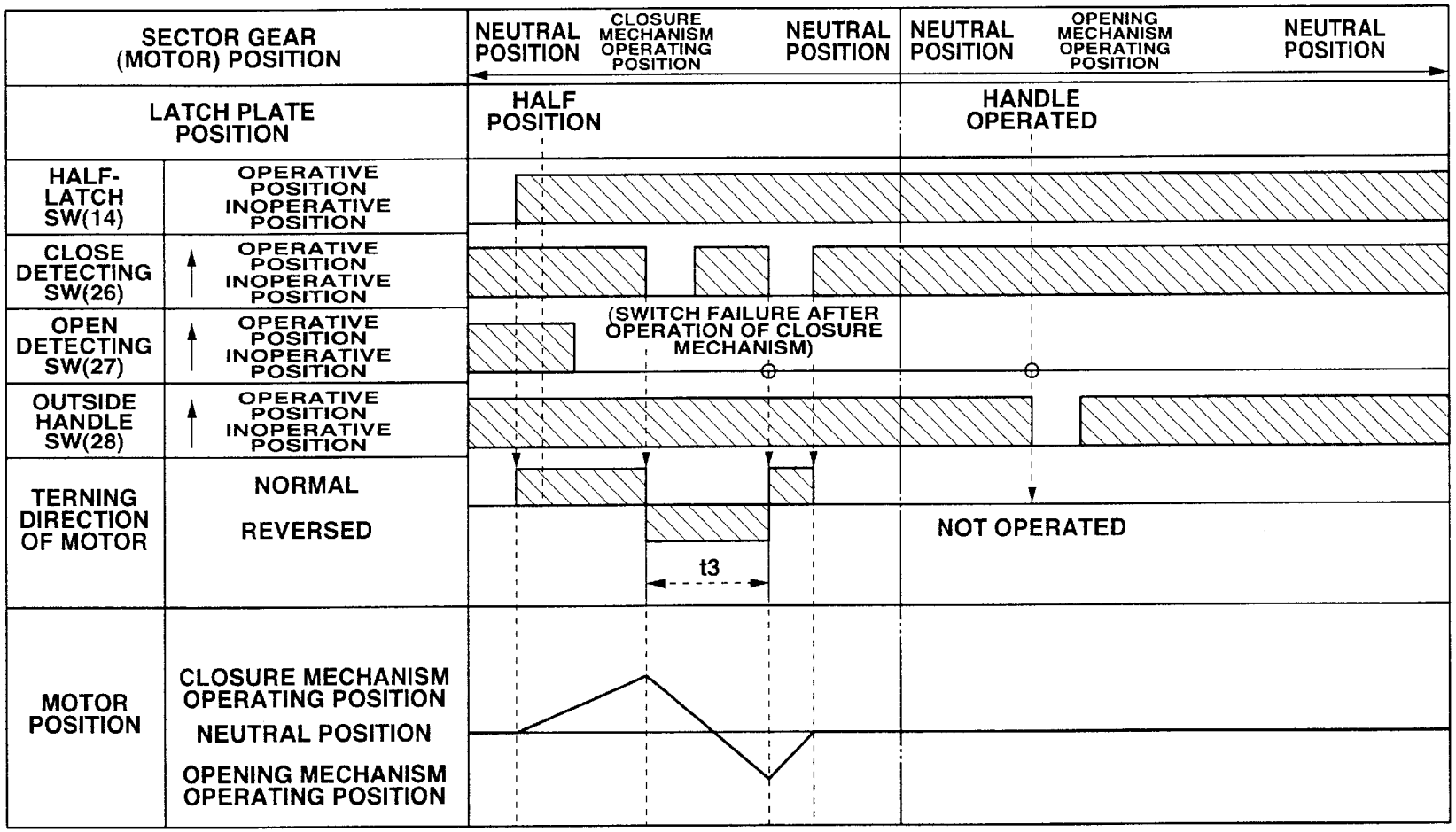
FIG. 18 is a time chart showing a switch failure back-up operation of the drive device in case wherein the open detecting switch fails to assume an inoperative position.

This failure will be described with the aid of the time chart of FIGS. 12 and 18. When, in the zone-③ of the time chart of FIG. 12, that is, when the open detecting switch 27 does not take the operative position within a predetermined time "t3" counted by a timer "T3" from the time when the motor 3 has started its reversed rotation, the motor 3 is forced to run in a normal direction upon completion of the time counting by the timer "T3". When the close detecting switch 26 assumes the operative position, the motor 3 is stopped.

Failure with Close Detecting Switch Kept in Operative Position

Figure 19:
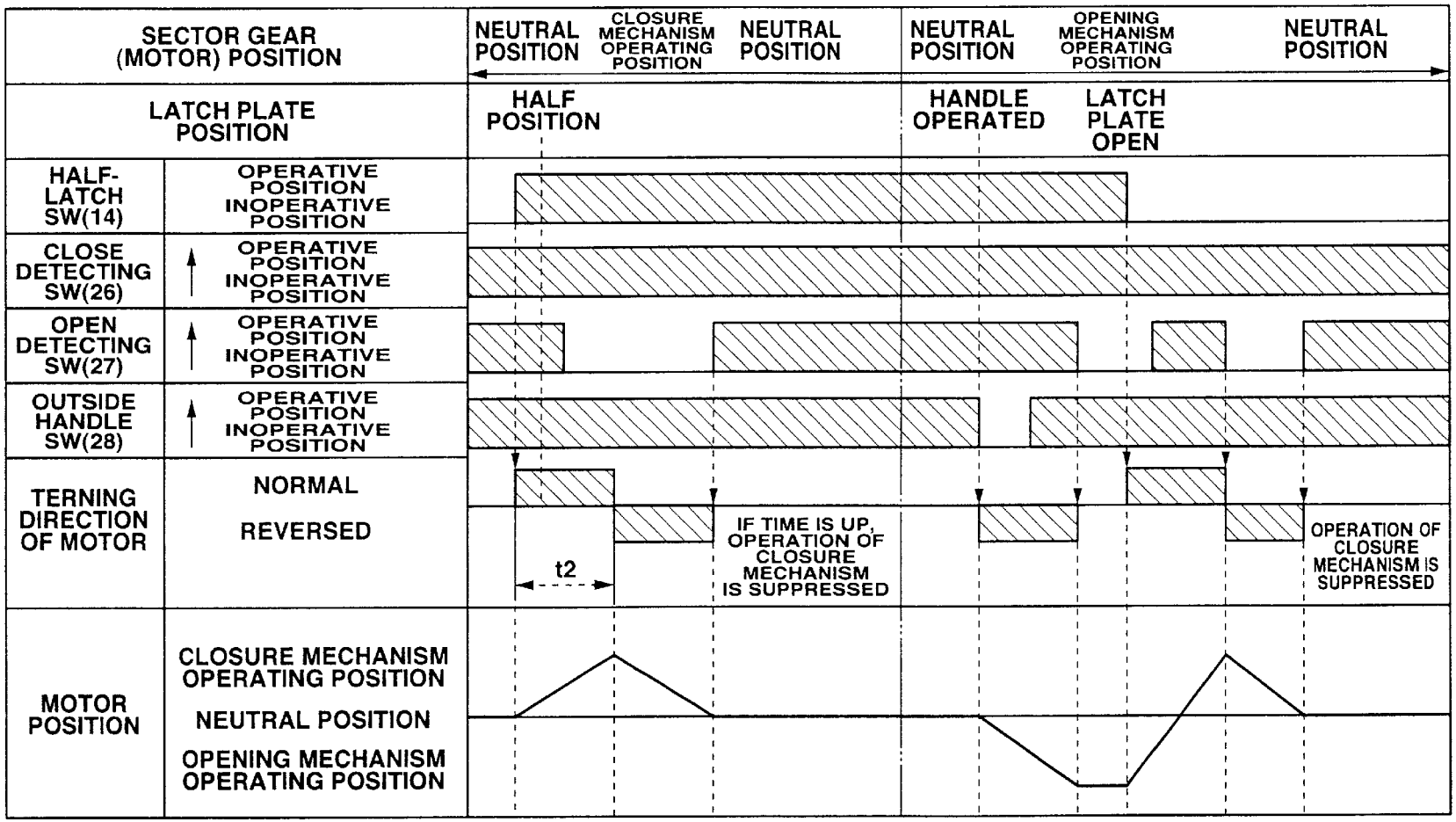
FIG. 19 is a time chart showing a switch failure back-up operation of the drive device in case wherein a close detecting switch fail to assume an inoperative position.

This failure will be explained with the aid of the time chart of FIGS. 12 and 19. When, in the zone-① of the time chart of FIG. 12, that is, when the close detecting switch 26 does not take its inoperative position with a predetermined time "t2" counted by a timer "T2" from the time when the half-latch switch 14 has assumed its inoperative position, the motor 3 is forced to run in a reversed direction upon completion of the time counting by the timer "T2" thereby to cause the close detecting switch 26 to return to the neutral condition. When the open detecting switch 27 assumes the operative position, the motor 3 is stopped.

Operation upon Recovering of Battery

When, due to some reasons, the battery 41 (see FIG. 11) is subjected to a failure or subjected to the breaking down of a wire, the control unit 40 stops its operation, and thus the drive device 2 is stopped in its halfway condition. When, now by repairing the wire, the control unit 40 is energized and the above-mentioned handling is applied to the closure mechanism or opening mechanism, the following operation takes place. That is, when the mechanism has been in a condition other than the neutral condition, the closure mechanism or opening mechanism is returned to the neutral condition and then controlled in such a way as instructed. Thus, even if the closure mechanism or opening mechanism has taken any condition at the time of power cut, the mechanism can start its function properly upon recovering of the power supply. This will be clarified from the following explanation.

Figure 20:
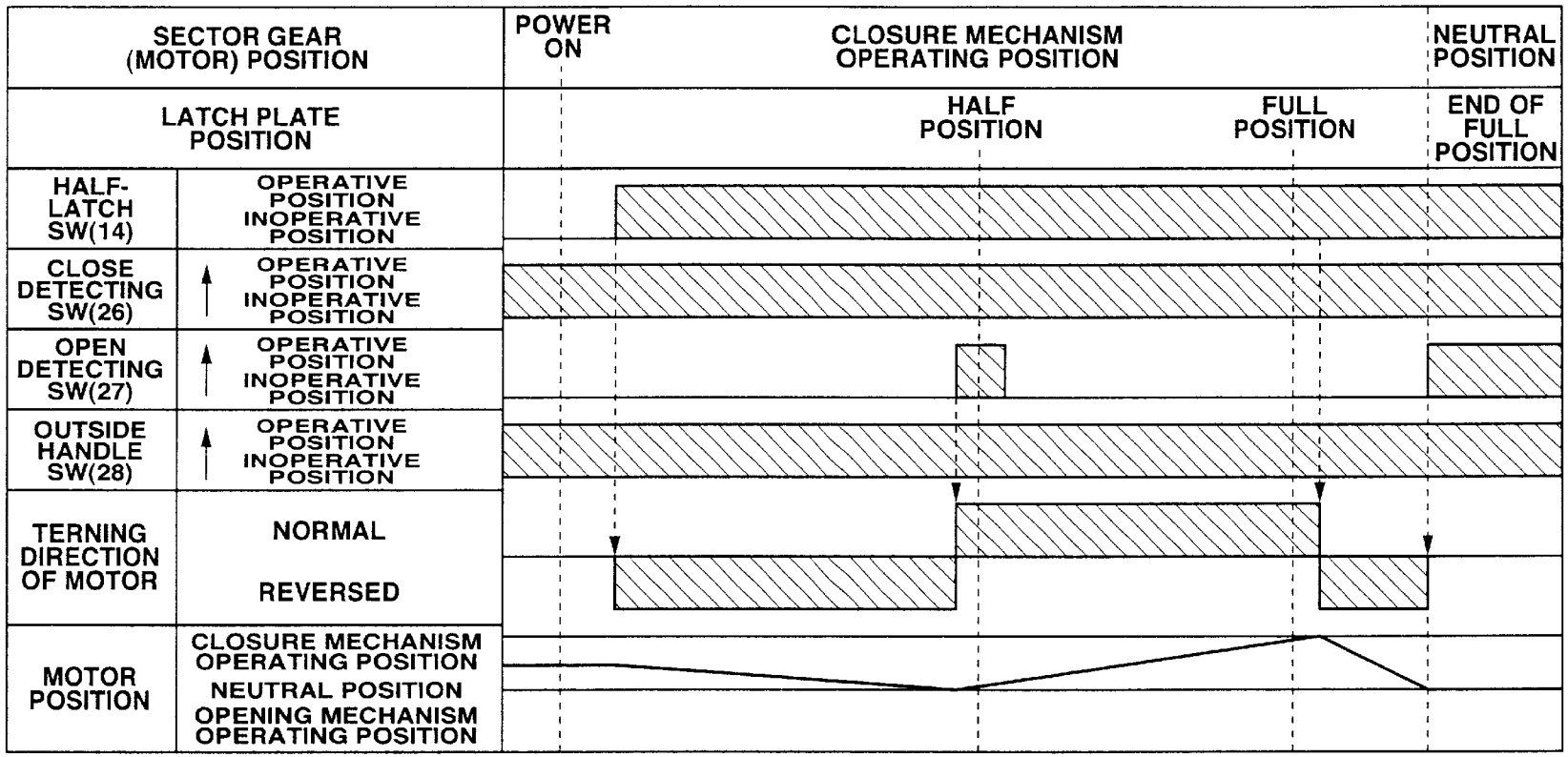
FIG. 20 is a time chart showing a power recover treating operation of the drive device, which takes place when the closure mechanism is actuated with a motor assuming a closure mechanism operating position.

In Case Wherein Closure Mechanism is Actuated with Motor Assuming Closure Mechanism Operating Position As is seen from the time chart of FIG. 20, due to the operative position of the half-latch switch 14, the motor 3 starts to run in a reversed direction and comes to the neutral position. After the open detecting switch 27 is actuated, the normal closing operation is carried out.

Figure 21:
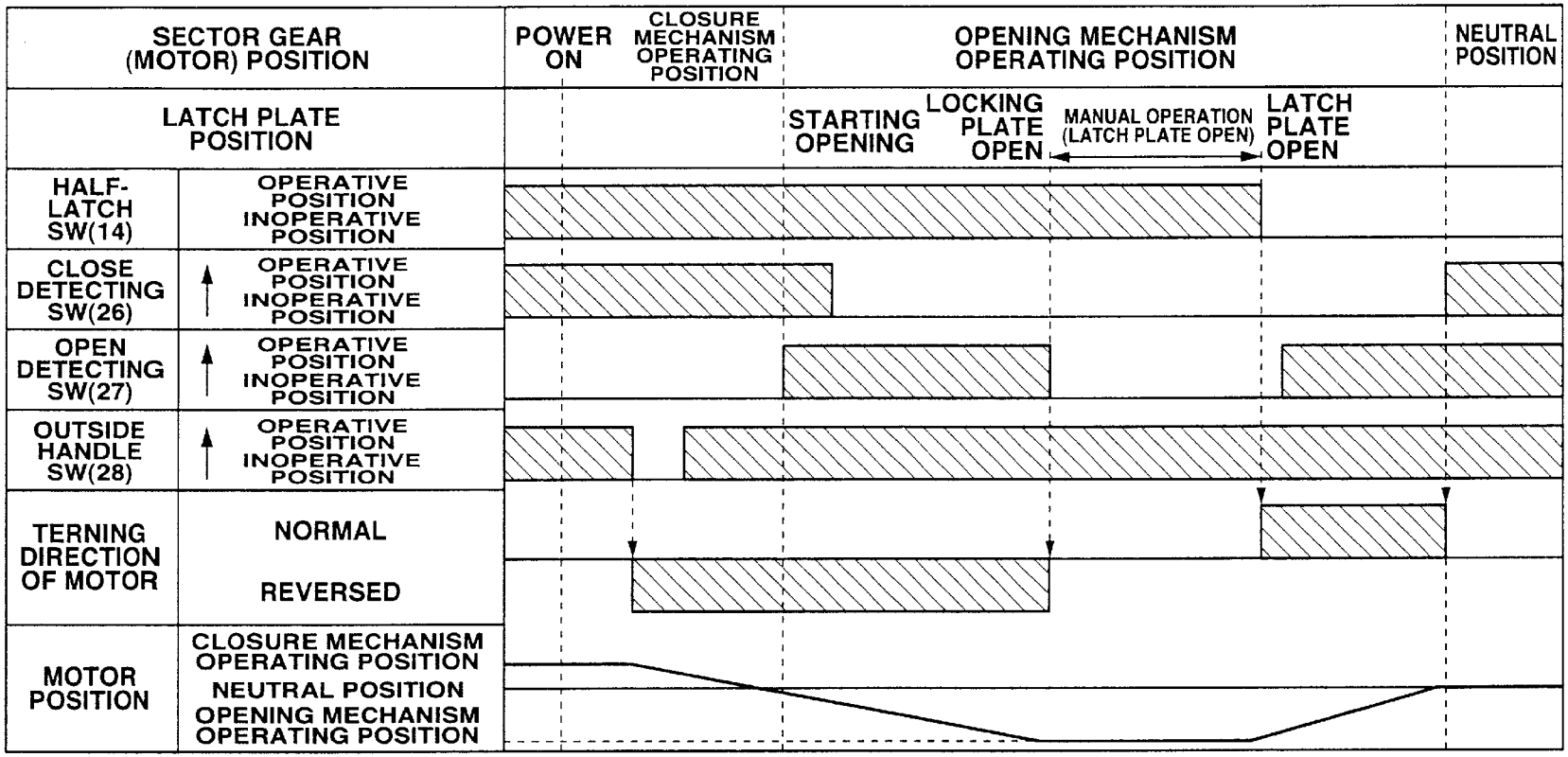
FIG. 21 is a time chart showing the power recover treating operation of the drive device, which takes place when the opening mechanism is actuated with the motor assuming the closure mechanism operating position.

In Case Wherein Opening Mechanism is Actuated with Motor Assuming Closure Mechanism Operating Position As is seen from the time chart of FIG. 21, due to the inoperative position of the outside handle switch 28, the motor 3 starts to run in a reversed direction to come to the neutral position and thereafter carries out the normal opening operation.

Figure 22:
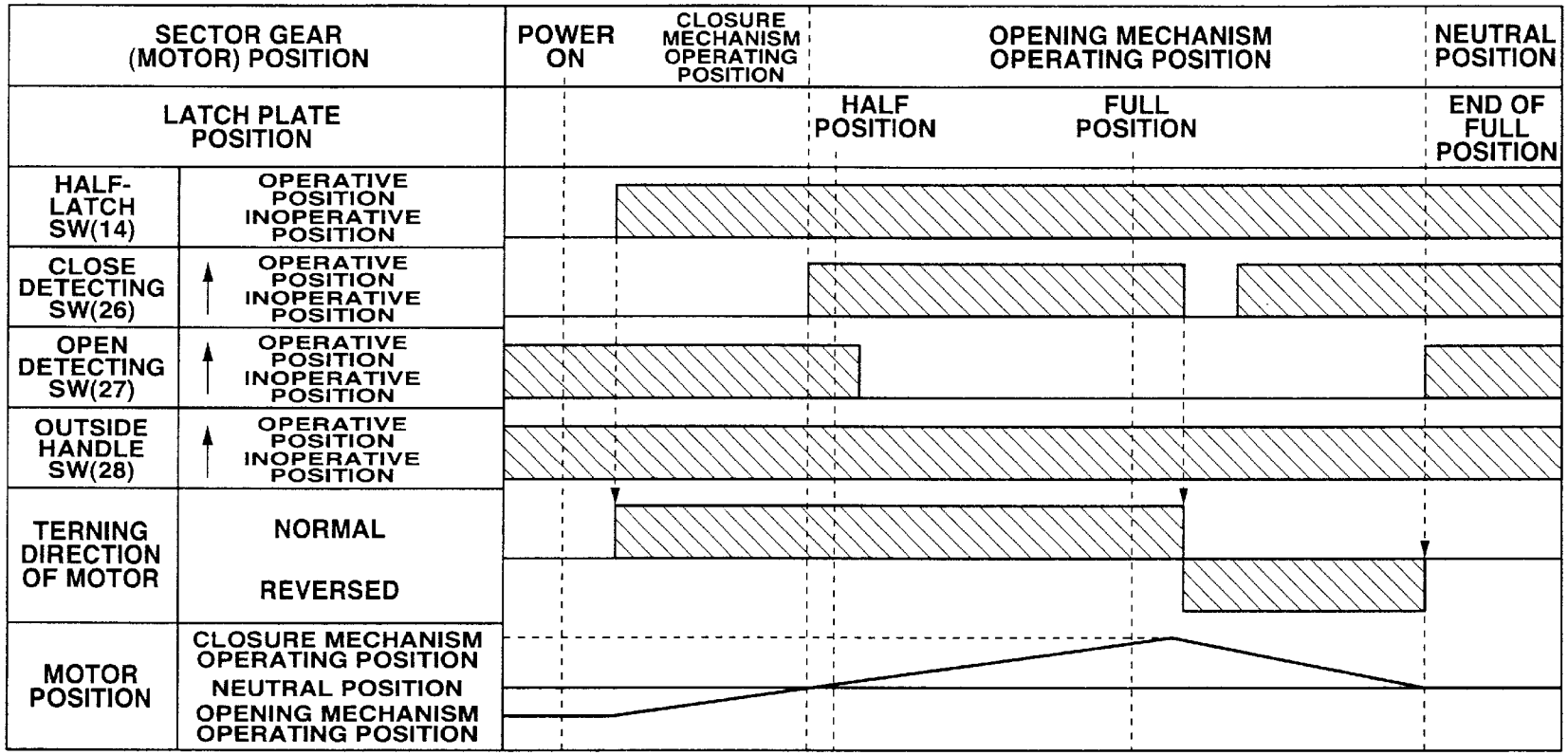
FIG. 22 is a time chart showing the power recover treating operation of the drive device, which takes place when the closure mechanism is actuated with the motor assuming the opening mechanism operating position.

In Case Wherein Closure Mechanism is Actuated with Motor Assuming Opening Mechanism Operating Position As is seen from the time chart of FIG. 22, due to the operative position of the half-latch switch 14, the motor 3 starts to run in a normal direction to come to the neutral position and thereafter carries out the normal closing operation.

Figure 23:
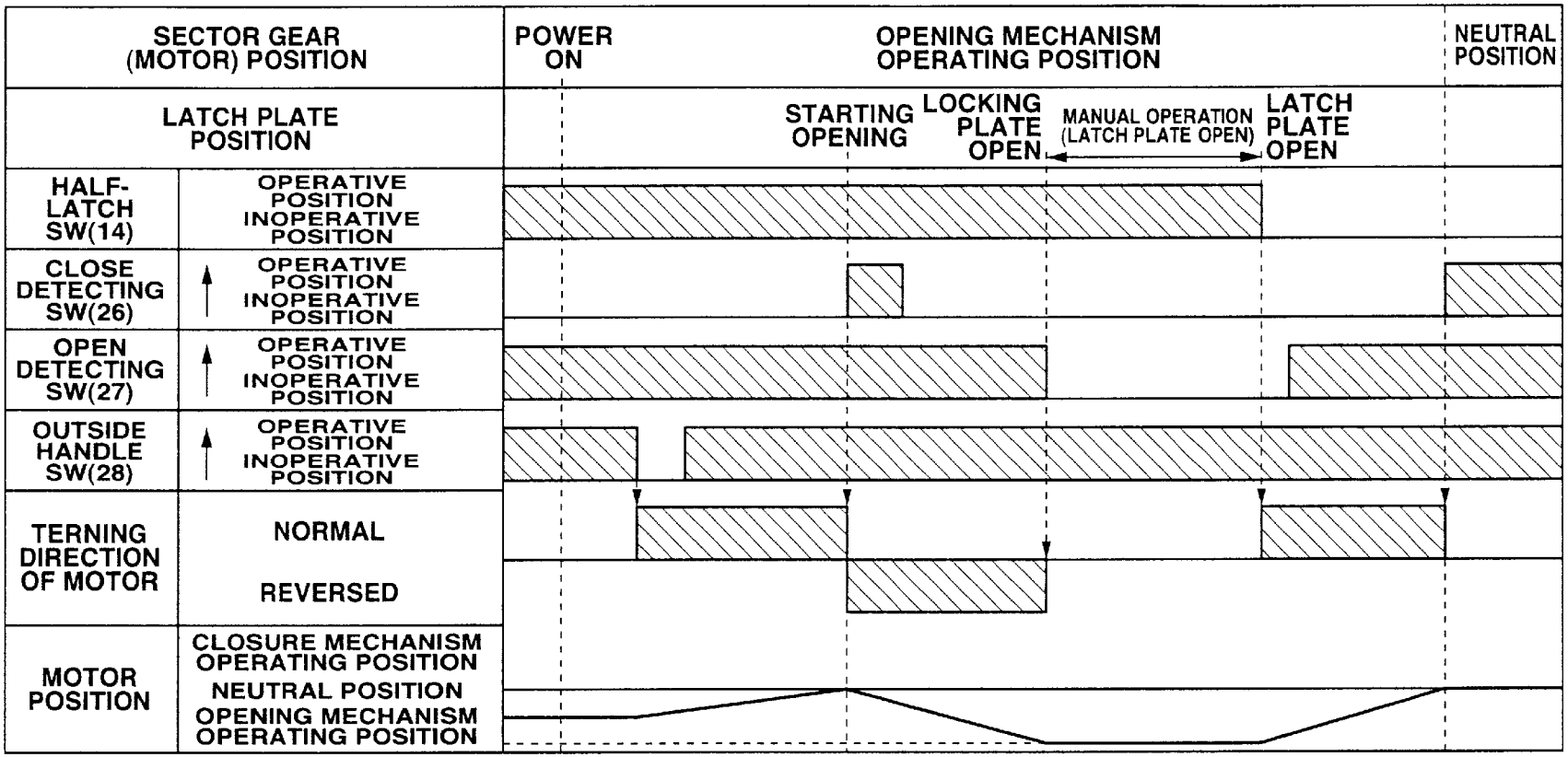
FIG. 23 is a time chart showing the power recover treating operation of the drive device, which takes place when the opening mechanism is actuated with the motor assuming the opening mechanism operating position.

In Case Wherein Opening Mechanism is Actuated with Motor Assuming Opening Mechanism Operating Position As is seen from the time chart of FIG. 23, due to the inoperative position of the outside handle switch 28, the motor 3 starts to run in a normal direction to comes to the neutral position and thereafter carries out the normal opening operation.

Figure 24:
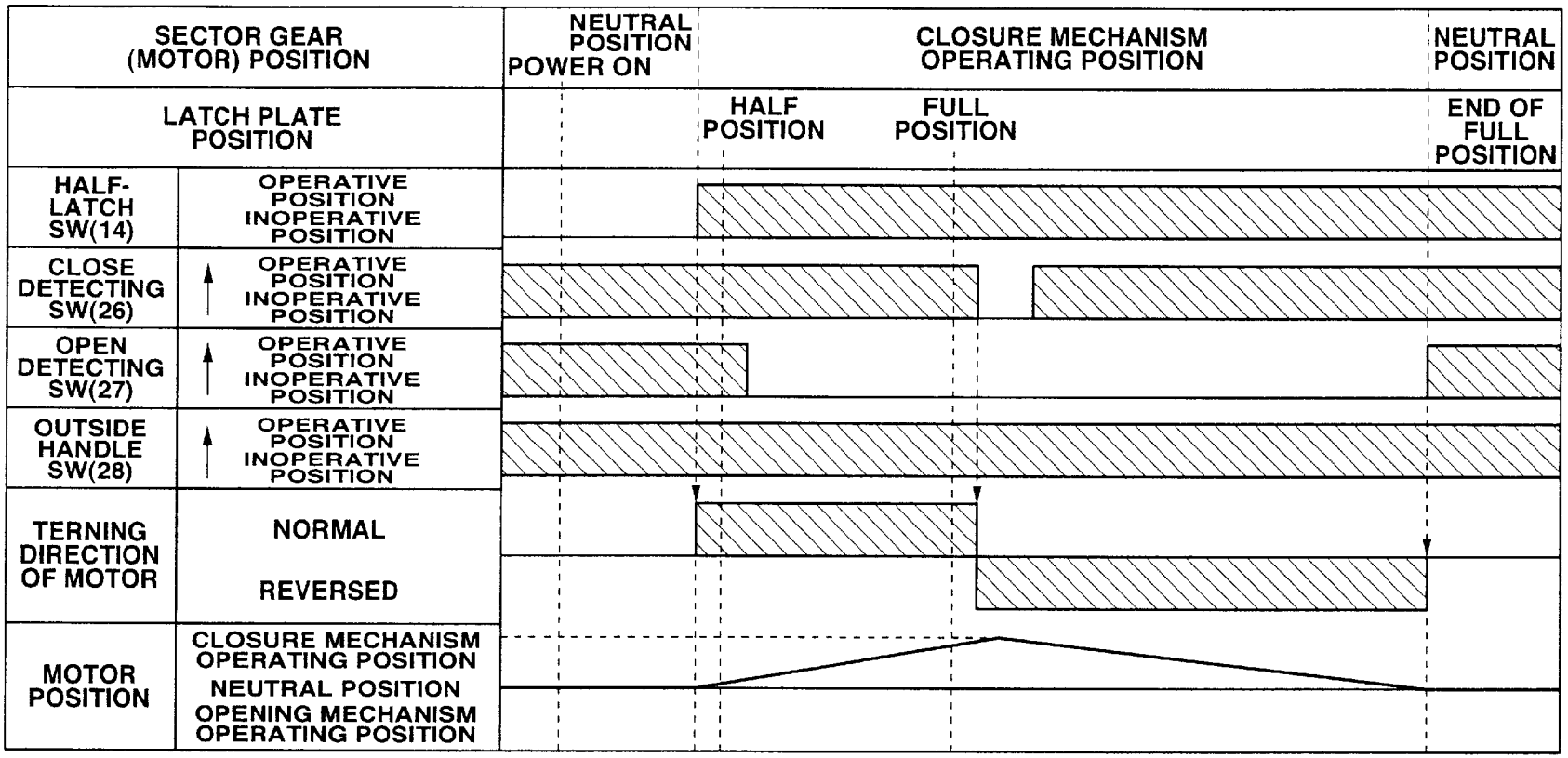
FIG. 24 is a time chart showing the power recover treating operation of the drive device, which takes place when the closure mechanism is actuated with the motor assuming a neutral position.

In Case Wherein Closure Mechanism is Actuated with Motor Assuming Neutral Position As is seen from the time chart of FIG. 24, in this case, when the closure mechanism is actuated, the normal closing operation starts.

Figure 25:
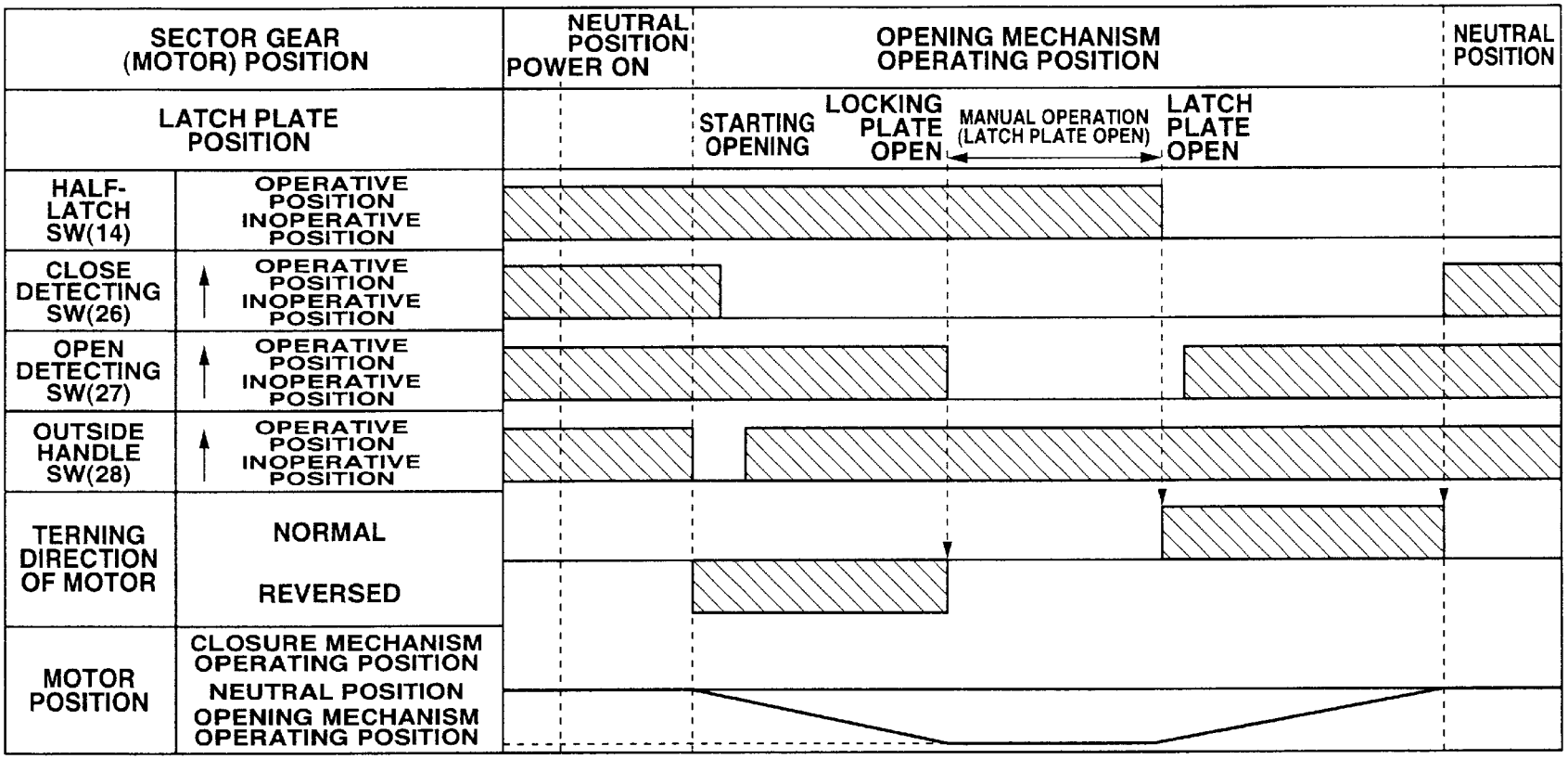
FIG. 25 is a time chart showing the power recover treating operation of the drive device, which takes place when the opening mechanism is actuated with the motor assuming the neutral position.

In Case Wherein Opening Mechanism is Actuated with Motor Assuming Neutral Position As is seen from the time chart of FIG. 25, when the opening mechanism is actuated, the normal opening operation starts.

Figure 26:
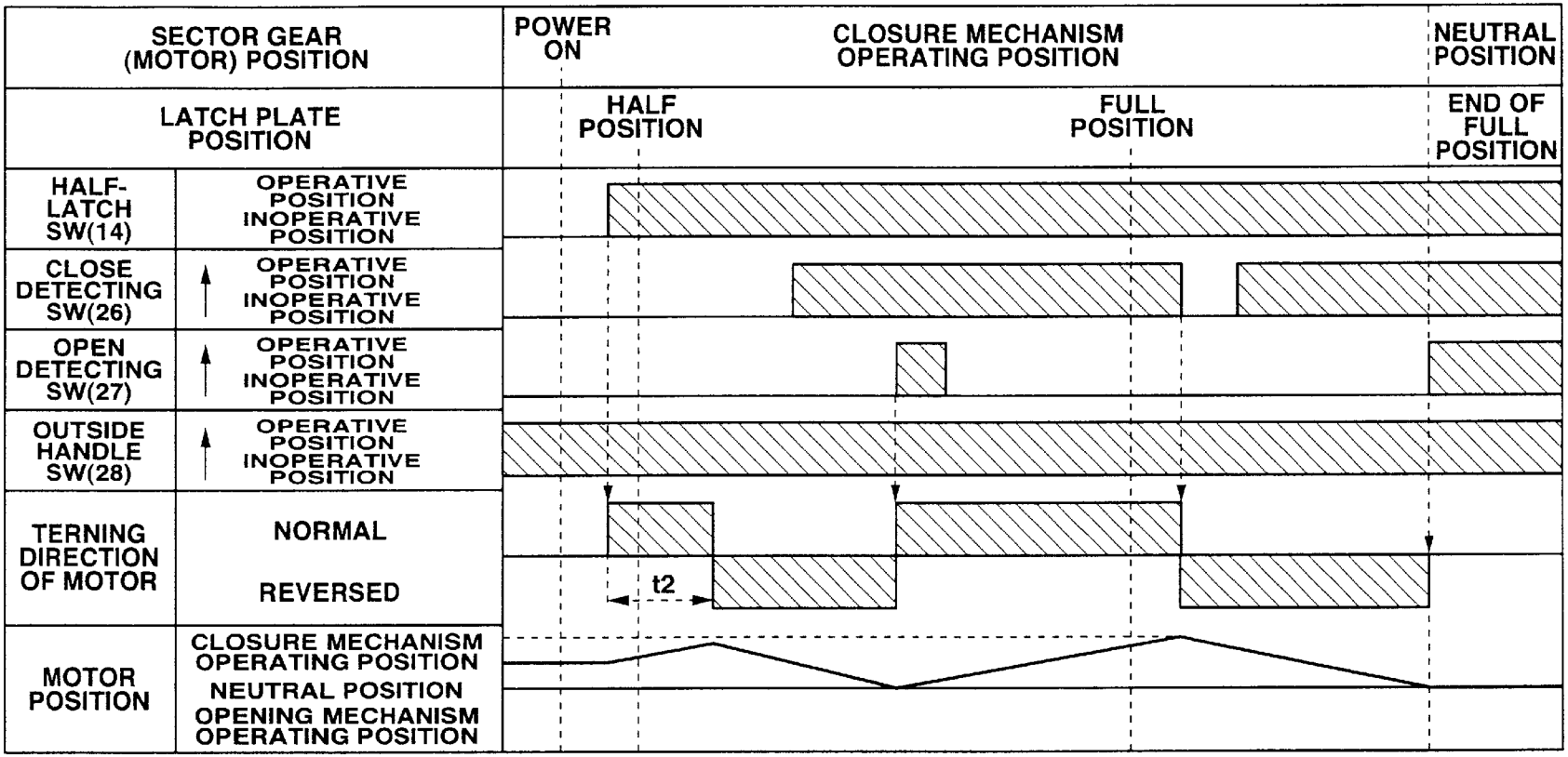
FIG. 26 is a time chart showing the power recover treating operation of the drive device, which takes place when the closure mechanism is actuated with the closure mechanism assuming a reversed rotation position.

In Case Wherein Closure Mechanism is Actuated with Closure Mechanism Assuming Reversed Rotation Position As is seen from the time chart of FIG. 26, upon reaching the operative position of the half-latch switch 14, the motor 3 starts to run in a normal direction. Upon this, the timer "T2" starts the time counting. If the open detecting switch 27 does not take the operative position within a predetermined time "t2" counted by the timer "T2", the motor 3 is forced to run in a reversed direction to the neutral position, and thereafter the normal closing operation is carried out.

Figure 27:
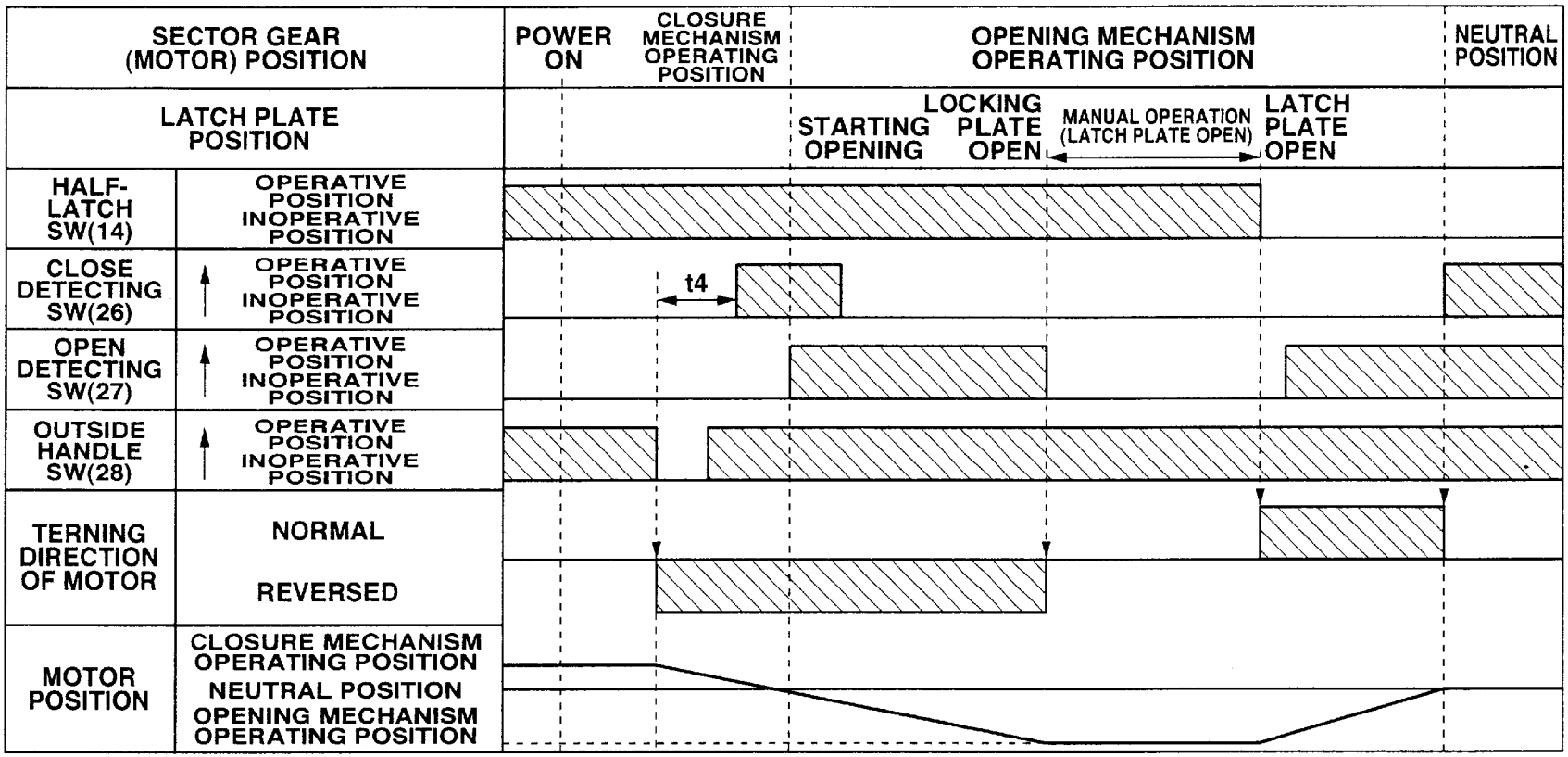
FIG. 27 is a time chart showing the power recover treating operation of the drive device, which takes place when the opening mechanism is actuated with the closure mechanism assuming the reversed rotation position.

In Case Wherein Opening Mechanism is Actuated with Closure Mechanism Assuming Reversed Rotation Position As is seen from the time chart of FIG. 27, due to the inoperative position of the outside handle switch 28, the motor 3 starts to run in a reversed direction. Upon this, the timer "T4" starts the time counting. If the close detecting switch 26 does its operative position within a predetermined time "t4" counted by the timer "T4", the motor 3 is returned to the neutral position and thereafter the normal opening operation is carried out.

Figure 28:
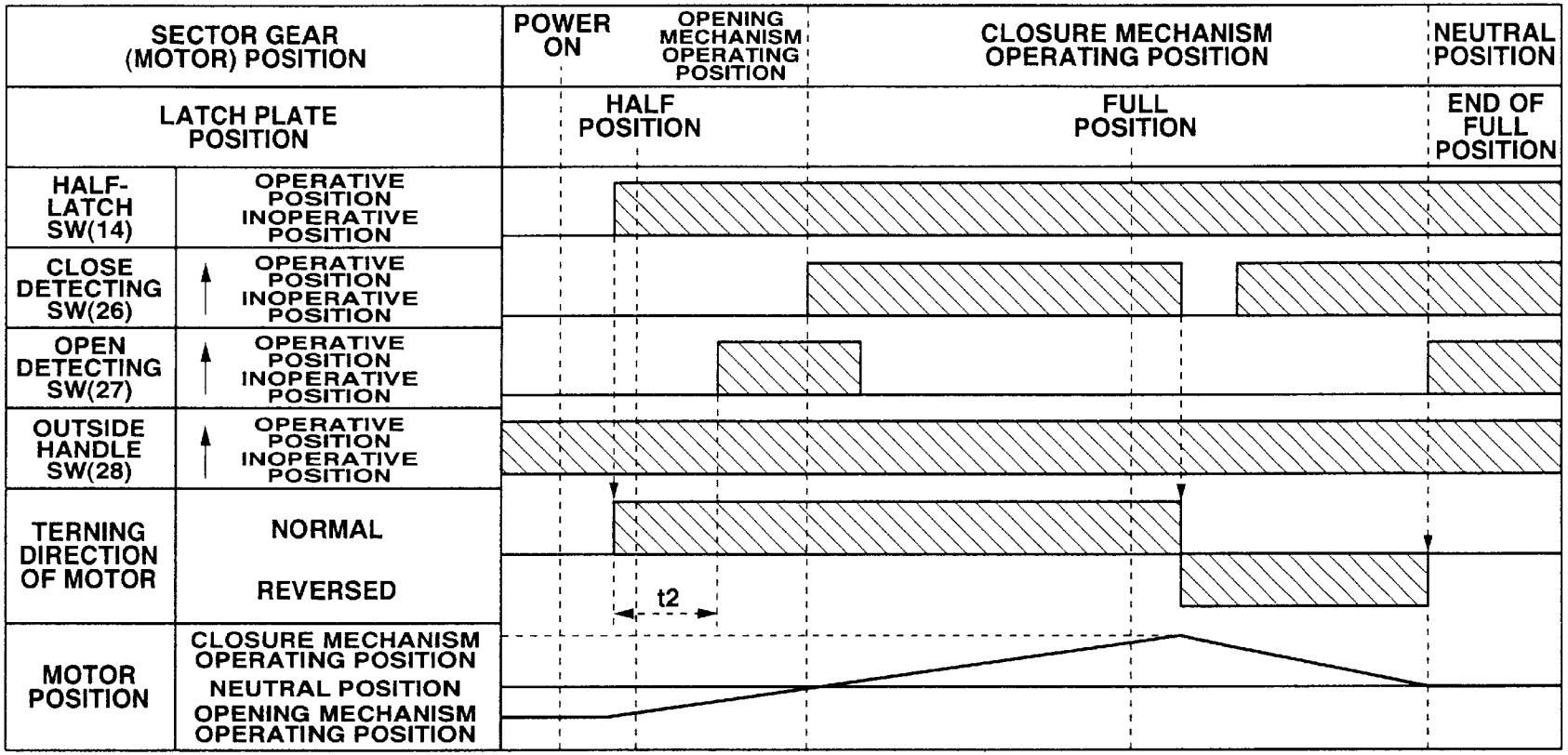
FIG. 28 is a time chart showing the power recover treating operation of the drive device, which takes place when the closure mechanism is actuated with the opening mechanism assuming the reversed rotation position.

In Case Wherein Closure Mechanism is Actuated with Opening Mechanism Assuming Reversed Rotation Position As is seen from the time chart of FIG. 28, due to the operative position of the half-latch switch 14, the motor 3 starts to run in a normal direction. Upon this, the timer "T2" starts the time counting. If the open detecting switch 27 takes an operative position within a predetermined time "t2" counted by the timer "T2", the motor 3 is turned to the neutral position and thereafter the normal closing operation is carried out.

Figure 29:
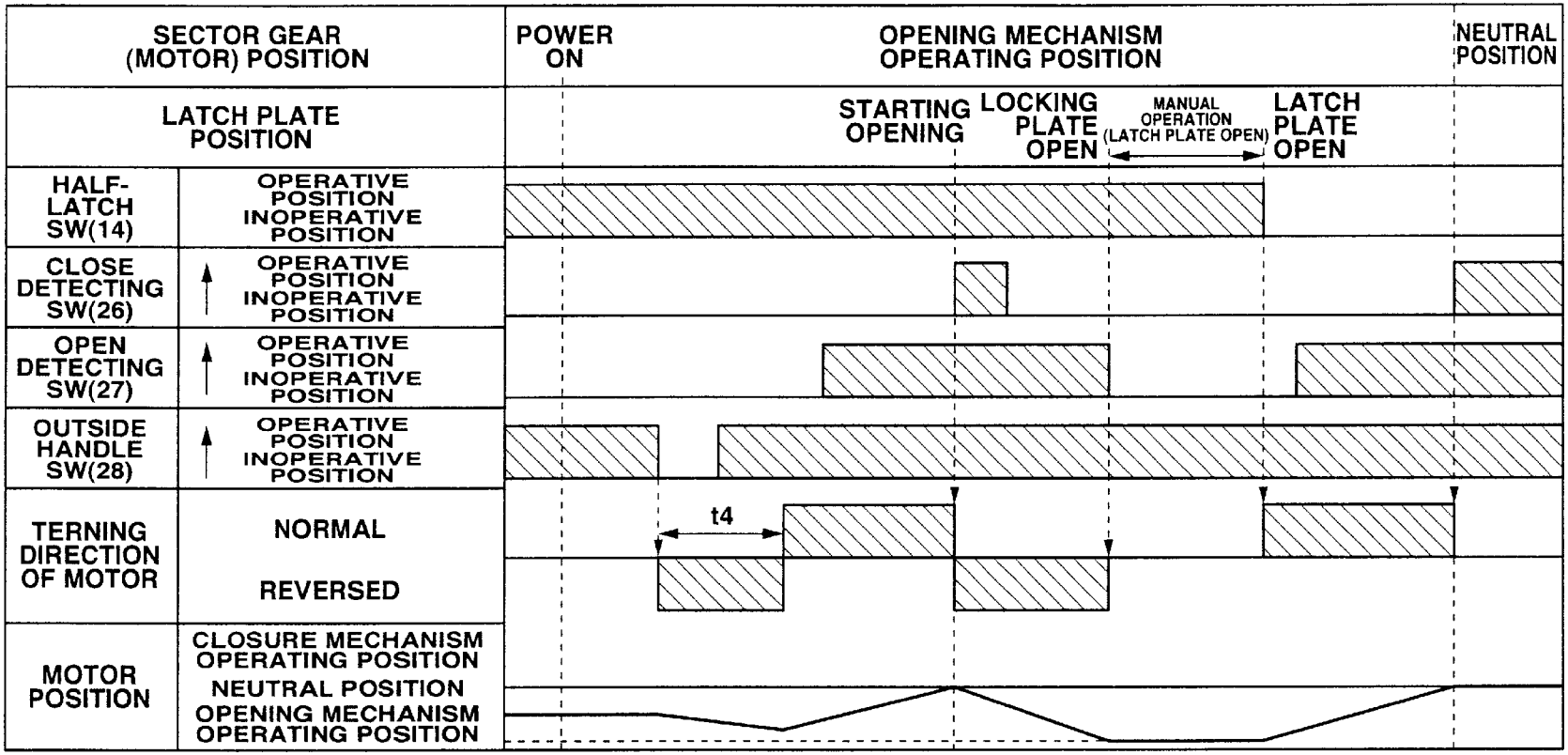
FIG. 29 is a time chart showing the power recover treating operation of the drive device, which takes place when the opening mechanism is actuated with the opening mechanism assuming the reversed rotation position.

In Case Wherein Opening Mechanism is Actuated with Opening Mechanism Assuming Reversed Rotation Position As is seen from the time chart of FIG. 29, due to the inoperative position of the outside handle switch 28, the motor 3 starts to run in a reversed direction. Upon this, the timer "T4" starts the time counting. If the close detecting switch 26 does not take the operative position within a predetermined time "t4" counted by the timer "T4", the motor 3 is turned in a normal direction to the neutral position, and thereafter the normal opening operation is carried out.

The entire contents of Japanese Patent Application 2001-312756 filed Oct. 10, 2001 are incorporated herein by reference.

Although the invention has been described above with reference to the embodiment of the invention, the invention is not limited to such embodiment as described above. Various modifications and variations of such embodiment may be carried out by those skilled in the art, in light of the above description.

What is claimed is:

1. An electric door lock device comprising:

a lock device including a latch plate engageable with a striker and a locking plate engageable with the latch plate to lock the same;

a drive device including a reversible electric motor, a moving member driven by the electric motor, a plurality of detection switches coupled to detect a position of said moving member, and a half-latch switch capable of sensing a half-latch position of the latch plate relative to the locking plate, the half-latch switch being arranged to issue a half-latch representing signal when the latch plate is about to take the half-latch position during a movement thereof that is induced when the door is being closed;

a closure mechanism which, upon sensing of the half-latch position by the half-latch switch, induces rotation of the electric motor in a normal direction to move the moving member from a neutral position defined by said plurality of detection switches, thereby moving the latch plate to a full-latch position relative to the locking plate, and upon arrival of the moving member at a reverse rotation position defined by said plurality of detection switches, induces rotation of the electric motor in a reversed direction thereby to return the moving member to the neutral position and stops rotation of the electric motor in response to said plurality of detection switches; and a control unit which is configured to carry out a given controlling of the electric motor when a given operation is carried out, the given operation being an operation wherein under operation of the closure mechanism, the door is moved in a close direction passing through the operative position of the half-latch switch and then moved back in an open direction at a position just before the half-latch position, the given controlling being so made that when the moving member takes a position other than the neutral position upon completion of the given operation, the electric motor is rotated in a reversed direction to move the moving member to the neutral position, and when the moving member takes the neutral position upon completion of the given operation, the electric motor is stopped to keep the moving member at the neutral position.

2. An electric door lock device as claimed in claim 1, in which two swing turns of the latch plate sensed by the half-latch switch at the time when the door is moved in a close direction passing through the operative position of the half-latch switch and moved back in an open direction at the position just before the half-latch position are used as an information signal for controlling the electric motor.

3. An electric door lock device as claimed in claim 2, further comprising an opening mechanism which, upon sensing manipulation of a handle, induces rotation of the electric motor in a reversed direction to move the moving member from the neutral position in a direction to cancel a locked engagement between the latch plate and the locking plate, and upon arrival of the moving member at the reverse rotation position, induces rotation of the electric motor in a reversed direction to return the moving member to the neutral position and stops rotation of the electric motor.

4. An electric door lock device comprising:

a lock device including a latch plate engageable with a striker and a locking plate engageable with the latch plate to lock the same;

a drive device including a reversible electric motor, a moving member driven by the electric motor, and a half-latch switch capable of sensing a half-latch position of the latch plate relative to the locking plate, the half-latch switch being arranged to issue a half-latch representing signal when the latch plate is about to take the half-latch position during a movement thereof that is induced when the door is being closed;

a closure mechanism which, upon sensing of the half-latch position by the half-latch switch, induces rotation of the electric motor in a normal direction to move the moving member from a neutral position thereby moving the latch plate to a full-latch position relative to the locking plate, and upon arrival of the moving member at a reverse rotation position, induces rotation of the electric motor in a reversed direction thereby to return the moving member to the neutral position and stops rotation of the electric motor; and a control unit which is configured to carry out a given controlling of the electric motor when a given operation is carried out, the given operation being an operation wherein under operation of the closure mechanism, the door is moved in a close direction passing through the operative position of the half-latch switch and then moved back in an open direction at a position just before the half-latch position.

the given controlling being so made that when the moving member takes a position other than the neutral position upon completion of the given operation, the electric motor is rotated in a reversed direction to move the moving member to the neutral position, and when the moving member takes the neutral position upon completion of the given operation, the electric motor is stopped to keep the moving member at the neutral position;

wherein two swing turns of the latch plate sensed by the half-latch switch at the time when the door is moved in a close direction passing through the operative position of the half-latch switch and moved back in an open direction at the position just before the half-latch position are used as an information signal for controlling the electric motor;

wherein said lock further comprises an opening mechanism which, upon sensing manipulation of a handle, induces rotation of the electric motor in a reversed direction to move the moving member from the neutral position in a direction to cancel a locked engagement between the latch plate and the locking plate, and upon arrival of the moving member at the reverse rotation position, induces rotation of the electric motor in a reversed direction to return the moving member to the neutral position and stops rotation of the electric motor; and wherein said door lock device further comprises:

a cam possessed by the moving member;

a close detecting switch engageable with the cam, and an open detecting switch engageable with the cam, wherein when the close and open detecting switches assume respective operative positions, the control unit stops operation of the electric motor judging that the moving member has taken the neutral position, when the close detecting switch assumes an operative position and the open detecting switch assumes an inoperative position, the control unit continues rotation of the electric motor in a normal direction judging that the moving member has taken a first position other than the neutral position, when the close detecting switch assumes an inoperative position and the open detecting switch assumes an operative position, the control unit continues rotation of the electric motor in a reversed direction judging that the moving member has taken a second position other than the first and neutral positions, and when the close and open detecting switches assume respective inoperative positions, the control unit rotates the electric motor in a reversed direction judging that the moving member has taken the reverse rotation position.

5. An electric door lock device as claimed in claim 4, in which when the moving member fails to arrival at the reverse rotation position within a predetermined time counted by a timer from a time when the moving member starts to move from the neutral position, the electric motor is rotated in a reversed direction to move the moving member back to the neutral position and stopped.

6. An electric door lock device as claimed in claim 5, in which when at least one of the closure and opening mechanisms fails to operate due to malfunction of at least one of the close and open detecting switches, the control unit brings about a function by which the moving member can be moved from the neutral position.

7. An electric door lock device as claimed in claim 4, further comprising a power recover treating system which controls the closure and opening mechanisms when an electric power returns after a power cut, the control unit using information signals from the open and close detecting switches as an information for detecting a position of the moving member.

8. An electric door lock device as claimed in claim 7, in which when it is detected that the moving member takes a position other than the neutral position, the control unit operates the electric motor to run in a direction to move the moving member to the neutral position and starts operation of one of the closure and opening mechanisms.

9. An electric door lock device comprising:

a lock device including a latch plate engageable with a striker and a locking plate engageable with the latch plate to lock the same;

a drive device including a reversible electric motor, a moving member driven by the electric motor, and a half-latch switch capable of sensing a half-latch position of the latch plate relative to the locking plate, the half-latch switch being arranged to issue a half-latch representing signal when the latch plate is about to take the half-latch position during a movement thereof that is induced when the door is being closed;

a closure mechanism which, upon sensing of the half-latch position by the half-latch switch, induces rotation of the electric motor in a normal direction to move the moving member from a neutral position thereby moving the latch plate to a full-latch position relative to the locking plate, and upon arrival of the moving member at a reverse rotation position, induces rotation of the electric motor in a reversed direction thereby to return the moving member to the neutral position and stops rotation of the electric motor;

an opening mechanism which, upon sensing manipulation of a handle, induces rotation of the electric motor in a reversed direction to move the moving member from the neutral position in a direction to cancel a locked engagement between the latch plate and the locking plate and upon arrival of the moving member at the reversed rotation position, induces rotation of the electric motor in a reversed direction to return the moving member to the neutral position and stops rotation of the electric motor;

a cam possessed by the moving member;

a close detecting switch engageable with the cam;

an open detecting switch engageable with the cam; and a control unit which is configured to carry out a given controlling of the electric motor when a given operation is carried out, the given operation being an operation wherein under operation of the closure mechanism, the door is moved in a close direction passing through the operative position of the half-latch switch and then moved back in an open direction at a position just before the half-latch position, the given controlling being so made that when the moving member takes a position other than the neutral position upon completion of the given operation, the electric motor is rotated in a reversed direction to move the moving member to the neutral position, and when the moving member takes the neutral position upon completion of the given operation, the electric motor is stopped to keep the moving member at the neutral position, wherein when the close and open detecting switches assume respective operative positions, the control unit stops operation of the electric motor judging that the moving member has taken the neutral position, when the close detecting switch assumes an operative position and the open detecting switch assumes an inoperative position, the control unit continues rotation of the electric motor in a normal direction judging that the moving member has taken a first position other than the neutral position, when the close detecting switch assumes an inoperative position and the open detecting switch assumes an operative position, the control unit continues rotation of the electric motor in a reversed direction judging that the moving member has taken a second position other than the first and neutral positions and when the close and open detecting switches assume respective inoperative positions, the control unit rotates the electric motor in a reversed direction judging that the moving member has taken the reverse rotation position.

* * * * *